US009127423B2

(12) United States Patent
Ball

(10) Patent No.: US 9,127,423 B2
(45) Date of Patent: Sep. 8, 2015

(54) BOLLARDS

(75) Inventor: Robert Nicholas Ball, Over Peover (GB)

(73) Assignee: ATG ACCESS LTD. (GB)

( * ) Notice: Subject to any disclaimer, the term of this patent is extended or adjusted under 35 U.S.C. 154(b) by 0 days.

(21) Appl. No.: 14/007,185

(22) PCT Filed: Mar. 29, 2012

(86) PCT No.: PCT/GB2012/050712

§ 371 (c)(1),
(2), (4) Date: Dec. 2, 2013

(87) PCT Pub. No.: WO2012/131381

PCT Pub. Date: Oct. 4, 2012

(65) Prior Publication Data

US 2014/0147201 A1 May 29, 2014

(30) Foreign Application Priority Data

Mar. 31, 2011 (GB) ..... 1105516.7

(51) Int. Cl.
*E01F 13/04* (2006.01)
*E01F 13/12* (2006.01)

(52) U.S. Cl.
CPC ..... *E01F 13/048* (2013.01); *E01F 13/046* (2013.01); *E01F 13/123* (2013.01)

(58) Field of Classification Search
CPC ..... E01F 13/12; E01F 13/00; E01F 13/046
USPC ..... 404/6, 9, 10
See application file for complete search history.

(56) References Cited

U.S. PATENT DOCUMENTS

| | | | |
|---|---|---|---|
| 1,574,908 | A | 3/1926 | Lamp |
| 1,848,516 | A | 3/1932 | Davison |
| 2,006,233 | A | 6/1935 | Chretien |
| 2,263,649 | A | 11/1941 | Sawyer |
| 3,810,595 | A | 5/1974 | Doolittle |
| 3,861,097 | A | 1/1975 | Patterson |

(Continued)

FOREIGN PATENT DOCUMENTS

| | | |
|---|---|---|
| CH | 700218 | 7/2010 |
| DE | 2309249 | 8/1974 |

(Continued)

OTHER PUBLICATIONS

GB Combined Search and Examination Report corresponding to GB1214276.6 dated Mar. 19, 2013.

(Continued)

*Primary Examiner* — Abigail A Risic
(74) *Attorney, Agent, or Firm* — Niels Huan; Dann Dorfman Herrell & Skillman, PC

(57) ABSTRACT

A telescopic bollard comprising: a bollard assembly, the bollard assembly including an outer bollard part defining a guide bore extending in a direction along the axis thereof from a base end to a head end thereof. An inner bollard part is housed within the guide bore so as to be slidingly moveable thereallong between: a telescopically retracted state in at least some of the length of the inner bollard part resides within the guide bore, and a telescopically extended state in which relatively less of the length of the inner bollard part resides within the guide bore and relatively more of said length extends beyond the head end of the outer bollard part.

4 Claims, 31 Drawing Sheets

(56) References Cited

U.S. PATENT DOCUMENTS

| | | | | |
|---|---|---|---|---|
| 4,240,766 | A | 12/1980 | Smith | |
| 4,576,508 | A | 3/1986 | Dickinson | |
| 4,635,492 | A * | 1/1987 | Uebelhart | 74/89.35 |
| 4,844,653 | A | 7/1989 | Dickinson | |
| 4,919,563 | A | 4/1990 | Stice | |
| 4,973,189 | A | 11/1990 | Bechtold | |
| 5,474,017 | A | 12/1995 | Mohebbi | |
| 5,481,828 | A | 1/1996 | Kentrotas | |
| 5,547,310 | A | 8/1996 | Muller | |
| 5,829,912 | A | 11/1998 | Marcotullio | |
| 5,975,792 | A | 11/1999 | Goeken | |
| 6,174,103 | B1 | 1/2001 | Stroman | |
| 6,435,760 | B1 | 8/2002 | Pettesch | |
| 6,626,606 | B1 | 9/2003 | Johnson | |
| 7,244,075 | B2 * | 7/2007 | Stadler | 404/6 |
| 7,481,599 | B2 * | 1/2009 | Stice | 404/6 |
| 7,607,856 | B2 | 10/2009 | Patel | |
| 7,850,391 | B2 | 12/2010 | Omar | |
| 8,096,727 | B2 | 1/2012 | Parenti | |
| 8,197,156 | B2 | 6/2012 | Morgan | |
| 8,215,865 | B2 | 7/2012 | Adler | |
| 8,277,143 | B2 | 10/2012 | Adler | |
| 8,523,479 | B2 * | 9/2013 | Adler et al. | 404/6 |
| 8,794,865 | B2 * | 8/2014 | Stadler | 404/6 |
| 2003/0051406 | A1 | 3/2003 | Ritz | |
| 2003/0145498 | A1 | 8/2003 | Venegas | |
| 2004/0091315 | A1 | 5/2004 | Yodock | |
| 2004/0151542 | A1 | 8/2004 | Johnson | |
| 2004/0159055 | A1 | 8/2004 | Stone | |
| 2005/0031411 | A1 | 2/2005 | Hensley | |
| 2005/0073275 | A1 | 4/2005 | Robb | |
| 2005/0098770 | A1 | 5/2005 | Schell | |
| 2006/0204327 | A1 | 9/2006 | Phelan | |
| 2006/0233608 | A1 | 10/2006 | Netah | |
| 2007/0031189 | A1 | 2/2007 | Stadler | |
| 2007/0086858 | A1 | 4/2007 | Morgan | |
| 2007/0258762 | A1 | 11/2007 | Stice | |
| 2008/0038056 | A1 | 2/2008 | Patel | |
| 2008/0038057 | A1 * | 2/2008 | Stadler | 404/6 |
| 2008/0112756 | A1 | 5/2008 | Omar | |
| 2008/0187396 | A1 | 8/2008 | McCue | |
| 2009/0047066 | A1 | 2/2009 | Stice | |
| 2009/0202296 | A1 | 8/2009 | Lamore | |
| 2009/0208285 | A1 | 8/2009 | Adler | |
| 2009/0250674 | A1 | 10/2009 | Darcy | |
| 2010/0166498 | A1 | 7/2010 | Adler | |
| 2010/0290832 | A1 | 11/2010 | House | |
| 2011/0033232 | A1 | 2/2011 | Adler | |
| 2012/0230764 | A1 | 9/2012 | Lafont | |
| 2012/0251236 | A1 | 10/2012 | Hild | |
| 2012/0308302 | A1 * | 12/2012 | Adler et al. | 404/6 |
| 2013/0034387 | A1 * | 2/2013 | Adler et al. | 404/6 |
| 2014/0003867 | A1 | 1/2014 | Ball | |
| 2014/0010591 | A1 | 1/2014 | Ball | |
| 2014/0017003 | A1 | 1/2014 | Ball | |
| 2014/0119825 | A1 | 5/2014 | Castro | |
| 2014/0147201 | A1 | 5/2014 | Ball | |
| 2014/0161521 | A1 | 6/2014 | Ball | |
| 2014/0161523 | A1 | 6/2014 | Ball | |
| 2014/0241798 | A1 * | 8/2014 | Sharipov | 404/6 |

FOREIGN PATENT DOCUMENTS

| | | | |
|---|---|---|---|
| DE | 3605747 | | 8/1987 |
| DE | 9316170 | | 3/1994 |
| DE | 9315671 | | 6/1994 |
| DE | 19631678 | | 2/1998 |
| DE | 19812116 | | 9/1999 |
| DE | 19815426 | | 10/1999 |
| DE | 202005013439 | | 11/2005 |
| DE | 102007052321 | A1 | 5/2009 |
| EP | 0176973 | | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2598484 | | 11/1987 |
| FR | 2621625 | | 4/1989 |
| FR | 2680190 | | 7/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 2775992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2012 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | | 2/1987 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | | 5/2009 |
| WO | 9709485 | | 3/1997 |
| WO | 2004048702 | | 6/2004 |
| WO | 2004099534 | | 11/2004 |
| WO | 2007001326 | | 1/2007 |
| WO | 2007008813 | | 1/2007 |
| WO | 2007018531 | A1 | 2/2007 |
| WO | 2007191977 | | 8/2007 |
| WO | 2007103394 | | 9/2007 |
| WO | 2009112159 | | 9/2009 |
| WO | 2010132616 | | 11/2010 |
| WO | 2013017837 | | 2/2013 |

OTHER PUBLICATIONS

GB Examination Report corresponding to GB 1214276.6 dated Jul. 22, 2013.

GB Search Report corresponding to GB 1113203.2 dated Jan. 25, 2012.

GB Search Report corresponding to GB1109010.7 dated Sep. 16, 2011.

GB Search Report corresponding to GB1214276.6 dated Nov. 17, 2012.

International Search Report corresponding to Application No. PCT/GB2012/051755 dated Mar. 12, 2013.

International Search Report corresponding to PCT/GB2012/051198 dated Aug. 30, 2012.

Written Opinion of the International Searching Authority corresponding to PCT/GB2012/051198 dated Aug. 30, 2012.

Written Opinion of the International Searching Authority corresponding to PCT/GB2012/051755 dated Mar. 12, 2013.

Search Report corresponding to Application No. GB1101513.8 dated May 26, 2011.

GB Combined Search and Examination Report corresponding to Application No. GB1214248.5 dated Aug. 29, 2012.

GB Search Report corresponding to Application No. GB1101514.6 dated May 27, 2011.

GB Combined Search and Examination Report corresponding to GB1214278.2 dated Dec. 10, 2012.

(56) References Cited

OTHER PUBLICATIONS

GB Search Report corresponding to GB1104802.2 dated May 25, 2012.
GB Search Report corresponding to GB1113211.5 dated Jan. 17, 2012.
International Search Report corresponding to PCT/GB2012/050175 dated May 23, 2012.
Written Opinion of the International Search Authority corresponding to PCT/GB2012/050176 dated May 21, 2012.
Written Opinion of the International Search Authority corresponding to PCT/GB2012/050173 dated May 22, 2012.
Written Opinion of the International Search Authority corresponding to PCT/GB2012/050175 dated May 23, 2012.
International Search Report corresponding to PCT/GB2012/050176 dated May 21, 2012.
International Search Report corresponding to PCT/GB2012/050173 dated May 22, 2012.
Search Report with abstracts and figures Aug. 18, 2010.
Search Report with abstracts and figures Aug. 19, 2010.
Search Report with abstracts and figures Aug. 19, 2010-bis.
Search Report with abstracts and figures Aug. 20, 2010.
Search Report with abstracts and figures Oct. 2, 2010.
Search Report with abstracts and figures Mar. 23, 2015.

* cited by examiner

BOLLARDS

RELATED APPLICATIONS

This application is a 371 application of International Application No. PCT/GB2012/050712 filed Mar. 28, 2012, which claims priority to United Kingdom Patent Application No. 1105516.7 filed Mar. 31, 2011. Each of the foregoing applications is hereby incorporated herein by reference.

The present invention relates to bollards, or to apparatus or components suitable for use in bollard assemblies, and particularly, though not exclusively, to fixed bollards and desirably to bollards which can extend and/or retract in length or height.

Bollards provide a barrier and/or warning sign as required, on roads, pavements, walk-ways, parking areas and other areas. They are sometimes required to be temporary in nature or at least replaceably removeable for periods of time when their presence is not required.

The most common type of bollard is widely regarded as being of the portable variety comprising a simple plastic, conical shape manually deployable to desired locations. The manual deployability of such portable bollards flows from their structural simplicity which renders them appropriately light-weight. However, as a result of this, such non-static bollards are nevertheless typically relatively insubstantial in structure.

Retractable bollards provide a means of stowing a bollard at a site. The visible presence/effect of a bollard is thereby removed, without requiring the bollard to be physically removed from the site. Usually, retractable bollards comprise a housing embedded within the local ground at a site, which acts as a sheath for a bollard limb. The bollard limb is typically retractably extendable from within the housing to a position upstanding from the housing and from the ground level within which the housing is embedded. In use, the bollard limb is upstanding, visible and put into effect. It may serve as a barrier or sign. When not required, it maybe retracted back into the housing so as to be no longer upstanding from the ground level.

The embedding of a housing within the local ground, the action of retractable extension of the bollard limb, and the general robustness of the retractable bollard assembly present diverse problems including, but not limited to: The requirement to embed the housing and the difficulties that may present in terms of time, cost or insufficient ground depth at a given location; accessibility to the innards of the housing once embedded to permit servicing and repair; the ingress of detritus into a ground-embedded housing; providing sufficient height to the bollard in use; providing sufficient strength to the bollard to allow it resist vehicular impact and, thereby, serve as an impact barrier; providing a smooth interface between moving parts of the bollard during retraction/extension; minimising weight to minimise the energy required to operate the bollard.

The invention, in various aspects, desirably may address one, some or each of these problems.

In a first of its aspects, the invention may provide a telescopic bollard comprising: a bollard assembly, the bollard assembly including an outer bollard part defining a guide bore extending in a direction along the axis thereof from a base end to a head end thereof, and an inner bollard part housed within the guide bore so as to be slidingly moveable therealong between: a telescopically retracted state in at least some of the length of the inner bollard part resides within the guide bore, and a telescopically extended state in which relatively less of the length of the inner bollard part resides within the guide bore and relatively more of said length extends beyond the head end of the outer bollard part; and a stop part attached (e.g. fixed) to the base end of the outer bollard part which projects across the guide bore to block movement of the inner bollard part past the base end upon retraction.

In this way, the invention in its first aspect enables use of a telescopic bollard part or limb which can be expanded telescopically to project or extend, and retracted safely such that the inner bollard part does not fall through the base of the outer bollard part sheathing it. As a result, the inner bollard part is assured to adopt the desired position relative to the outer bollard part in the retracted state. This is especially useful as a safeguard in case of failure of the means used to maintain the bollard assembly in the telescopically extended state (e.g. mechanical means (mechanism), hydraulic ram or the like as would be readily appreciated by the skilled person). The bollard assembly may be adapted to be embedded within a ground level, and may be housed within a housing so adapted. The housing may include a top surface adapted to be uppermost in use and through an opening in which the bollard part is in communication with local ground level to enable it extend from local ground level, via the opening, when in the extended state. The housing may possess a base part arranged in spaced opposition to the stop part at the base end of the outer bollard part. This spacing may define a base chamber of the housing. The spacing or chamber so provided may house other components of the bollard assembly, such as parts of a mechanical or hydraulic ram for moving the bollard assembly between the retracted and extended states, and/or may serve as a drainage space below the bollard limb for collecting detritus (e.g. dirt, water etc) falling into the housing via the opening. The stop part prevents the inner bollard part falling into the space or chamber in such a case. The inner and outer bollard parts are preferably arranged such that the distal end of the inner bollard part is substantially flush with the head end of the outer bollard part when in the retracted state. The head end of the outer bollard part may be arranged, or positionable, to be substantially flush with the top surface of the housing. This enables a substantially level positioning of the ends of the inner and outer bollard parts at the local ground level.

The outer bollard part may comprise a tube part or other such conduit shape defining the guide bore, such as a cylindrical tube, or other suitable shape. Most preferably, the bore of the tube part has a bore surface intimately adjacent and opposed to an outer surface of the inner bollard part for guiding movement of the inner bollard part therealong. The inner bollard part may also be tubular, having an inner bore. Use of a tube(s) reduces weight, and permits access to the innards of the bollard assembly (e.g. the housing) via the inner and outer bollard parts.

The base end of the outer bollard is preferably defined by a terminus (e.g. of a tube) against which the stop part is positioned or attached (e.g. fixed). It has been found that attaching the stop part to the bore surface, or outermost side surface, wall or flank surface of the outer bollard part adds and focuses significant levels of stress and strain to the outer bollard structure. This is particularly important if the bollard is to be used as an impact barrier required to absorb vehicular impact forces and energies. Such forces have been found to have a more damaging effect upon the bollard at the points where the stop part is fixed to the outer bollard part if it is fixed to it at its (e.g. curved) bore or outer surface parts. By avoiding such parts for fixing the stop part to the outer bollard part, this more damaging effect is avoided. For example, the stop part is preferably not located within the bore of the outer bollard part, but at the surface thereof at its extreme terminal base end. For example, if the outer bollard part is a cylindrical tube, the terminus of the tube part may be an annular surface circumscribing the aperture of the tube part defining an opening to the bore of the tube part. The annular surface may be oriented generally transversely to the axis of the bore and so, by being positioned or fixed against that, the stop part may also be oriented generally transversely to the bore axis. The stop part may be welded to the outer bollard part, e.g. when both are made from metal, such as steel. A few (e.g. between two and six or so) spot welds may be preferable so as to reduce structural strains introduced by welding. Other fixings may be used.

The stop part may be fixed to the outer bollard part via a collar member fixed to the outer bollard part. The collar member may embrace the outer bollard surface of the outer bollard part at or adjacent the terminal base end of the outer bollard. The lowermost surface of the collar member may be flush with the terminal base end of the outer bollard part. The stop part may be fixed (e.g. welded) to the lowermost collar surface thereby to be adjacent or abutted against the terminal base end surface of the outer bollard part. Alternatively, the collar member may embrace the outer bollard surface, or at least closely surround it, without being directly fixed thereto but, instead, be indirectly fixed thereto via the stop part where the stop part is directly fixed (e.g. welded) to the terminal base end of the outer bollard. Thus the collar member may be held in place upon the bollard by its fixture to the stop part without requiring it to be directly fixed to the bollard part. This reduces the points of fixture required upon the bollard part (e.g. weld locations). The collar member may be fixed (e.g. welded) to the stop part and the stop part may be fixed (e.g. welded) to the base end of the outer bollard in substantially the same operation or procedure. Spot welds or preferably fillet welds may be used. The collar member may comprise two or more separate collar parts each of which embrace the outer surface of the outer bollard part wherein one of which is nearest the base end of the outer bollard part and fixed thereto (directly or indirectly as described above), and the other(s) of which are axially spaced from the former collar part by spacer members which fix the separate collar parts together. A basket-like arrangement may be provided in this way to hold the base end of the outer bollard member and provide bearing/sliding surfaces (or a structure to support such surfaces) about the outer surface of the outer bollard member at and adjacent its base end.

The terminal end surface of the outer bollard part (e.g. the aforesaid annulus) may include a chamfered outer edge to which the stop part is fixed (directly or indirectly), e.g. by welding. The outer bollard part may define an outer surface extending in a direction along its axis from the periphery of a chamfered edge at the terminus (base end) of the outer bollard part at which the stop part is welded to the outer bollard part. The chamfered edge permits a space or gap to be formed when the stop part is abutted against the terminus of the outer bollard part for receiving welds, e.g. spot welds. Thus, a terminal surface of the outer bollard part and a facing surface of the stop part are simultaneously accessible to the weld material without requiring (and generally avoiding) such weld material interacting with the inner or outer side walls or flanks of the outer bollard member (e.g. the curved, tubular surfaces if a tube).

The telescopic bollard may include a housing part in which the outer bollard part is mounted in register with a base chamber of the housing part, such as described above, located between the base of the housing part and the base end of the outer bollard part. The stop part preferably projects across the guide bore at least partially, so as to render parts of the guide bore between the stop part and said head end in communication with the base chamber via the stop part. The stop part may project across the guide bore in a direction substantially perpendicular to the axis of the outer bollard part.

The base chamber may be arranged in spaced opposition to the base end of the outer bollard part. The chamber so provided may house other components of the bollard assembly, such as parts of a mechanical, electrical or hydraulic ram for moving the bollard assembly between the retracted and extended states, and/or may serve as a drainage space below the bollard limb for collecting detritus (e.g. dirt, water etc) falling into the housing via the opening. The stop part preferably prevents the inner bollard part falling into the drainage space. Preferably, the stop part does not close the bore of the outer bollard part so that the bore can communicate with the base chamber past the stop part. The stop part may comprise a plate or ring fixed to the terminus of the outer bollard part, and/or may comprise a limb, digit or simple protrusion (or an array of separate protrusions) which extend across the guide bore at its terminus.

The stop part may comprise a plate or ring member having an aperture positioned in register with the guide bore defining a through-opening in communication with the guide bore wherein a width of the aperture is less than the width of the inner bollard part within the guide bore. Most preferably at least a part of the periphery of the aperture passes across the guide bore, or over the aperture defining the end of the guide bore. Consequently, most preferably, the guide bore may be in communication with the base chamber via the through-opening.

The stop part may define a seat against which the inner bollard part is arranged to rest when in the fully retracted state. For example, the axial length of the inner bollard part may substantially match the linear distance between the head end of the outer bollard part and the surface parts of the stop part against which the inner bollard part rests in the fully retracted state. This provides a firm support for the inner bollard when retracted, allowing the stop part to maintain the position of the inner bollard part when external forces press down against the head end of the inner bollard part e.g. when passing pedestrians or vehicles exert their weight upon the head end the retracted inner bollard. The stop part may define a terminal end of the outer bollard part.

The telescopic bollard may include an actuator disposed within the housing part and the inner bollard part to extend along the guide bore past the stop part and into the inner bollard part. The base of the actuator may be housed within the aforementioned chamber defined by the space between the base of the housing and stop part at the base end of the outer bollard part. The actuator may be attached/fixed to the housing part within this chamber so as to be, in use, directly underneath the outer and inner bollard parts and in register with the longitudinal axes (i.e. the telescopic extension axis) of both. The actuator part is preferably operable to retractably extend along the guide bore to urge the inner bollard part between a retracted state and an extended state.

The telescopic bollard may include a housing part, such as described above, within which the outer bollard part is slidingly housed or mounted so as to be slidingly moveable relative thereto. The outer bollard part may be so moveable between a telescopically retracted state in which at least some of the length of the outer bollard part is housed within the housing, and a telescopically extended state in which relatively less of the length of the outer bollard part resides within the housing and relatively more of said length extends beyond the housing part. As a result, the telescopically moveable parts of the bollard may themselves be mutually telescopic.

This allows the bollard parts to collectively define a fully extended bollard having a length significantly exceeding the length of the same bollard when fully retracted. The height of the housing able to fully contain the inner and outer bollard parts, when retracted, may be significantly less than the height of the two parts when fully extended. This is a significant improvement in the weight, size, cost and effort involved in not only manufacturing the whole bollard apparatus, but also in installing it within the ground.

The aforementioned stop part of the outer bollard part in its fully retracted state is preferably arranged to rest upon one or more abutment parts of the housing part above or within the aforementioned base chamber. The abutment part(s) may comprise one or more beams, ribs or ledges within the base and above the base of the housing defining the bottom of the base chamber (in use) arranged to position the stop part above the base of the housing or base chamber. This is preferable to avoid water or detritus which may collect within the base chamber, from soiling the retracted outer bollard part. The same is preferably also true of the aforementioned ram which may be attached at its base to an abutment part.

In a second of its aspects, the invention may provide a bollard assembly comprising: a guide bore, and a bollard part housed within the guide bore to extend therealong from a base end of the bollard part so as to be slidingly moveable along the guide bore between: a retracted state in at least some of the length of the bollard part is resides within the guide bore, and an extended state in which relatively less of the length of the bollard part resides within the guide bore and relatively more of said length extends beyond the guide bore; a collar part fixed to said base end and at least part of which is positioned between an outer surface of the bollard part and an opposing inner surface of the guide bore thereby to form a sliding interface therebetween and wherein the collar part is fixed to the bollard part at other than said opposed outer surface. The collar part is preferably fixed at, or to, the base end or terminus of the bollard part. The bollard part may be tubular, such as cylindrical or some other suitable tubular shape. The fixture is preferably at other than an outer tubular (e.g. curved) surface in such a case. The collar part may be fixed to the bollard part by an interference fit and/or by welding. Preferably, no welding is applied to the opposed outer surface of the bollard part.

In this way, a sliding interface is provided between a sliding bollard and a bore within which the bollard slides.

The terminal end surface of the bollard part may include a chamfered outer edge to which the collar part is fixed e.g. by welding. The bollard part may define an outer surface extending in a direction along its axis from the periphery of a chamfered edge at the terminus (base end) of the bollard part at which the collar part is welded to the bollard part. The chamfered edge permits a space or gap to be formed when the collar part is abutted against the terminus of the bollard part for receiving welds, e.g. spot welds. Thus, a terminal surface of the bollard part and an adjacent surface of the collar part are simultaneously accessible to the weld material without requiring (and generally avoiding) such weld material interacting with the inner or outer side walls or flanks of the bollard part (e.g. the curved, tubular surfaces if a tube).

The opposed outer (e.g. tubular) surface may extend from the periphery of a chamfered edge at the base end to which the collar part is fixed.

The collar part may comprise a first ring part spaced from a second ring part along the longitudinal axis of the bollard part by a plurality of ring spacer members joining both ring parts wherein each said ring part circumscribes said longitudinal axis around said opposed outer (e.g. tubular) surface to form said sliding interface and the first ring part is fixed (e.g. welded) to the terminus of the bollard part.

The collar part preferably extends along the opposed outer surface of the bollard part from a first collar portion to a second collar portion via an intermediate waist portion of the collar part wherein each of the first and second collar portions forms a said sliding interface but the waist portion between them does not.

The first collar portion may be fixed (e.g. welded, and/or interference fit) to the terminus of the bollard part.

The bollard part may include an inner guide bore and an inner bollard part housed within an inner guide bore of the bollard part so as to extend therealong from a base end of the inner bollard part so as to be slidingly moveable along the inner guide bore between: a telescopically retracted state in at least some of the length of the inner bollard part resides within the inner guide bore, and a telescopically extended state in which relatively less of the length of the inner bollard part resides within the inner guide bore and relatively more of said length extends beyond the inner guide bore.

The telescopic bollard may include an inner collar part fixed around the base end of the inner bollard part and positioned between an outer surface of the inner bollard part and an opposing inner surface of the inner guide bore thereby to form a sliding interface therebetween.

The inner collar part may be fixed to the terminus of the base end of the inner bollard part by an interference fit, or by welds, with the opposed outer surface of the inner bollard part.

The collar part may be fixed (e.g. welded, or by interference fit) to the terminus of the inner bollard part at other than said opposed outer surface thereof.

The bollard part of the invention in its first aspect preferably comprises an outer bollard part containing said inner bollard part according to the invention in its first aspect, as described above.

The bollard assembly may form a part of a vehicle impact barrier.

In a third of its aspects, the invention may provide a bollard assembly comprising: a guide bore, and a tubular bollard part mounted within the guide bore to extend therealong from a base end of the bollard part so as to be slidingly moveable along the guide bore between: a retracted state in at least some of the length of the bollard part is housed within the guide bore, and an extended state in which relatively less of the length of the bollard part resides within the guide bore and relatively more of said length extends beyond the guide bore; and, a bearing part attached to the bollard part between an outer tubular surface of the bollard part and an opposing inner surface of the guide bore thereby to form a sliding interface therebetween wherein the bearing part is moveable relative to the bollard part to adjustably vary the separation between the sliding interface and the bollard part.

The bearing part may present separate interface surface parts each adapted for selectably providing said sliding interface and each being spaced by a different respective amount from an axle about which the bearing part is rotatably mounted to the bollard part thereby being separately positionable by action of rotation about said axle to adjustably vary the separation between the sliding interface and the bollard part.

The axle may be substantially parallel to the longitudinal axis of the column.

The interface surface parts of the bearing part may form surface parts of a column attached to the bollard part via said axle.

The axle may be substantially parallel to the longitudinal axis of the bollard part.

One or more said interface surface parts may preferably present a convex curvature. The radius of that curvature may substantially match the radius of curvature of the inner surface of the guide bore and preferably coincides therewith when the interface surface part is positioned to form said sliding interface.

The bearing part may present a substantially polyhedral shape defined partly by contiguous said interface surface parts.

The bearing part may be attached to the bollard part via a mounting assembly fixed to the bollard part and including a regular polygonal aperture having the same number of sides as there are said separate interface surface parts and adapted to intimately receive a correspondingly polygonal end of the bearing part in any one of a plurality of orientations each of which aligns the polygonal end with the polygonal aperture to allow the polygonal end to be received therein, wherein each orientation positions a selectably different one of the separate interface surface parts as said sliding interface. The correspondingly polygonal end of the bearing part may comprise an axial projection (e.g. axially coincident with the axle) having a correspondingly polygonal cross sectional shape (e.g. a regular polygonal shape) having dimensions to be closely received by and reciprocally match the polygonal aperture. The width or diameter of the projection may be less than the corresponding width or diameter of the bearing part between interface surface parts. The axial projection may comprise a polygonal nut, or other insert, seated within and projecting out from a correspondingly polygonal seat formed in an end surface of the bearing part centred on the axis of the bearing part (e.g. the axle). Thus, the nut or insert may be seated simultaneously within the polygonal aperture of the mounting assembly and within the polygonal seat of the bearing part to render the bearing part as a whole (including the nut/insert) irrotatable relative to the mounting assembly unless/until the nut/insert is extracted from the polygonal aperture and/or the seat. The nut/insert may be removably insertable into that seat. When a polygonal nut, it may be attached to a threaded end of the axle. The polygonal shape may be a hexagon.

The bollard assembly may comprise multiple said bearing parts arrayed circumferentially around the bollard part.

In a fourth of its aspects, the invention may provide a telescopic bollard assembly comprising: a housing part containing a bollard part, the bollard part including an outer bollard part mounted slidingly in the housing part and defining a guide bore extending in a direction along the axis of the outer bollard part towards a head end thereof, and an inner bollard part having a base end mounted slidingly within the guide bore to be moveable therealong between: a telescopically retracted state in at least some of the length of the inner bollard part is housed within the guide bore, and a telescopically extended state in which relatively less of the length of the inner bollard part resides within the guide bore and relatively more of said length extends beyond the guide bore; wherein the outer bollard part includes a detachable stop part at the head against which the base end is arranged to urge when the inner bollard part is moved to an extended state such that the outer bollard part is urged to move slidingly relative to the housing part, the stop part being detachable to permit movement of the base end past the head end and out of the guide bore.

The stop part may include a buffer part comprising a shock-absorbing material against which the base end is arranged to urge when in an extended state such that the outer bollard part is urged thereat to move slidingly relative to the housing part.

The stop part preferably projects across the guide bore in a direction substantially perpendicular to the said axis of the outer bollard part.

The stop part may be shaped as a ring having an outer ring diameter exceeding the diameter of the guide bore and an inner diameter which is less than the diameter of the guide bore and through which the inner bollard part is arranged to extend when in said telescopically extended state.

The telescopic bollard may include an actuator assembly attached within the housing part to the inner bollard part and being operable and arranged to retractably extend along the guide bore to move the inner bollard part to urge the base end thereof against the stop part thereby to urge the outer bollard part to move slidingly relative to the housing part, wherein the actuator assembly is arranged to extend at a rate of extension which falls as the base end approaches the stop part.

In a fifth of its aspects, the invention may provide a bollard assembly comprising: a first assembly part including a first aperture defining a through-opening, a second assembly part having a second aperture defining a through-opening; a first threaded connector member adapted to extend through the first aperture and the second aperture concurrently to engage with a reciprocally threaded second connector member collectively to sandwich therebetween portions of the first and second assembly parts; a seat part shaped to hold the second connector member substantially to prevent rotation thereof when seated, the seat part being mounted to the first assembly part to be slidingly moveable adjacent thereto between: a first position which places the seat part in register with the first and second apertures, and a second position which exposes the seat part permitting removal and replacement of the second connector member when seated therein.

The seat part may be slidingly moveable rectilinearly between the first position and the second position.

The bollard assembly may include a guide part defining a rectilinear path along which the seat part is restrained to slide between the first position and the second position.

The first assembly part may include a third aperture spaced from said first aperture and defining a through-opening in register with which the seat part is positionable by said sliding to render the seat part accessible therethrough to permit said removal and replacement of the second connector member therethrough.

The seat part may be dismountable from the first assembly part through the third aperture when in register therewith.

The seat part may comprise an aperture formed within a side of a slideable plate part and shaped to receive the second connector member therein.

The bollard assembly may comprise a second seat part attached to the first seat part and shaped to hold a spare second connector member, being slidingly moveable between a position in which the second seat part is sandwiched between the first assembly part and the second assembly part, and a position which exposes the second seat part permitting retrieval of the spare second connector when seated there.

In a sixth of its aspects, the invention may provide a bollard assembly comprising: a housing part containing a bollard part mounted moveably therein, and a hydraulic pump assembly housed within a compartment of the housing part and serving a hydraulic actuator arranged to urge the bollard part to move relative to the housing part between: a retracted state in which at least some of the length of the bollard part resides within the housing part, and an extended state in which relatively less of the length of the bollard part resides within the housing part and relatively more of said length extends beyond the housing part; wherein a side wall of the housing part includes an aperture defining a first housing outlet adjacent the base of the housing part, and a base of the compartment spaced from the base of the housing part includes an aperture defining a second housing outlet facing in a direction towards the base of the housing part.

A side wall of the compartment may include an aperture defining a third housing outlet adjacent the second housing outlet.

The third housing outlet preferably faces in a direction generally transverse to the direction in which the first housing outlet faces.

The bollard assembly may include an aperture defining a fourth housing outlet in a side wall of the compartment opposite to that containing the third housing outlet and substantially in register therewith.

The base of the compartment may include an aperture defining a fifth housing outlet located adjacent the fourth housing outlet and facing in a direction towards the base of the housing part and generally transverse to the direction in which the fourth housing outlet faces.

The bollard assembly may include an aperture defining a sixth housing outlet adjacent the base of the housing part in a side wall of the housing part opposite to that containing the first housing outlet and positioned substantially in register with the first outlet opening.

A bollard assembly may include one or more cover plates attached to the housing part at a respective said aperture to close the housing outlet thereat, and one or more duct members each comprising a duct terminating at a flange attached to the housing part at a said aperture to place the duct in register with the aperture therewith to define an outlet duct. The cover plate(s) may be detachably attachable to the housing part. The duct members may be detachably attachable to the housing part. Screws and/or bolts of the like. An, some or each duct part may present a coupling structure permitting the coupling to it of an external conduit (e.g. tuning, cabling or piping or the like). Examples include a threading at/near a terminal end of the duct part outwardly presented for interfacing with a reciprocal threading to attach an external conduit thereto, or a lip, rim or ridge arrangement (e.g. circumferential to the duct) to couple to an external conduit (e.g. a push-fit or snap fit coupling of the like). This means that an appropriate duct may be selectively attached to the housing part to present the coupling structure best suited to couple to an external conduit which may be required to couple to the housing part via the duct, when the housing part is put in place in the ground. Pre-existing external conduits there will possess pre-existing coupling structures to which the housing part can be adapted.

In a seventh of its aspects, the invention may provide a bollard assembly comprising: a housing part containing a hollow bollard part mounted therein to be slidingly moveable relative to the housing part, and an actuator part arranged within the hollow of the bollard part to urge the bollard part to move relative to the housing part from: a retracted state unsupported by the actuator in which at least some of the length of the bollard part resides within the housing part, to an extended state supported by the actuator part in which relatively less of the length of the bollard part resides within the housing part and relatively more of said length extends beyond the housing part; and, a fixed stop part extending into the hollow of the bollard part between the head of the bollard part and the actuator part; and, a detachable interface part arranged within the hollow of the bollard part between the stop part and the actuator part to abut the stop part and to be abutted by the actuator part to permit the actuator part via the interface part to support the bollard part at the stop part in the extended state; wherein the actuator part is operable to disengage from the interface part when the bollard part is in the retracted state to permit the interface part to separate from the stop part to be detached therefrom to enable access to the actuator part within the hollow of the bollard part.

Non-limiting examples shall now be discussed which illustrate exemplary embodiments of the invention, with reference to the accompanying drawings of which:

In the drawings, like reference symbols refer to like features.

Figure 1:
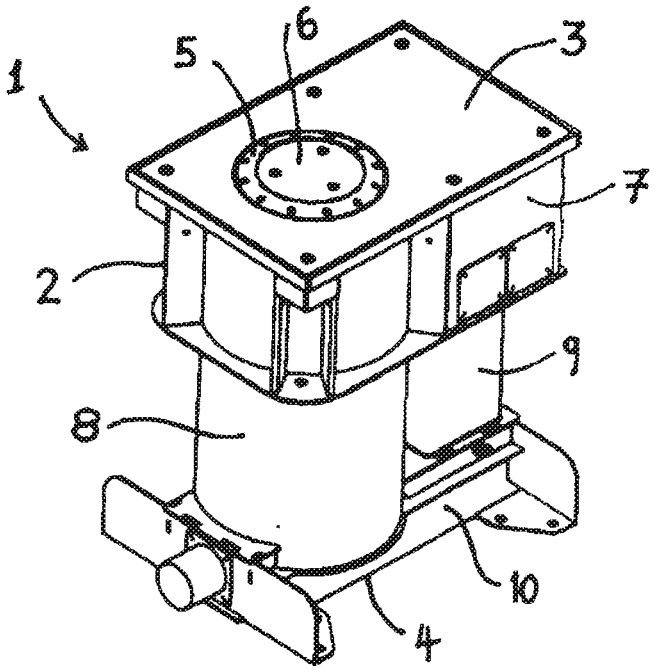
FIG. 1 illustrates a perspective view of a telescopic bollard assembly with a telescopic bollard, comprising an inner bollard tube and an outer bollard tube, in a fully retracted state.

Referring to FIG. 1 there is illustrated a telescopic bollard assembly (1) comprising a housing (2) containing a telescopic tube assembly comprising an outer bollard tube (5) and an inner bollard tube (6) housed within the bore of the outer bollard tube.

The telescopic tube assembly is housed within a casing tube (8) of the housing (2) defining within it a guide bore (see FIG. 11) extending in a direction along the axis of the casing tube from a base end thereof adjacent to the base (4) of the housing to a head end thereof adjacent to the top cover (3) of the housing uppermost in use.

The outer bollard tube is housed within the guide bore of the casing tube of the housing so as to be slidingly moveable therealong between a telescopically retracted state (as per FIGS. 1, 2 and 3) within which substantially the length of the outer bollard tube resides within the guide bore of the casing tube, and a telescopically extended state (as per FIGS. 4 and 5) in which relatively less of the length of the outer bollard tube resides within the guide bore of the casing tube and relatively more of its length extends from the head end of the casing tube.

The inner bollard tube (6) is housed within the tubular bore of the outer bollard tube which defines a guide bore (see FIG. 11) extending in a direction along the axis of the outer bollard tube from a base end thereof to a head end thereof uppermost in use. The head end of the inner bollard tube is topped with a top plate (11) which covers and closes the tubular bore of the inner bollard tube. The inner bollard tube (6) is housed within the guide bore of the outer bollard tube so as to be slidingly moveable therealong between a telescopically retracted state in substantially the length of the inner bollard part resides within the guide bore of the outer bollard tube (as per FIG. 1), and a telescopically extended state in which relatively less of the length of the inner bollard tube resides within the guide bore of the outer bollard tube and relatively more of its length extends from the head end of the outer bollard tube (as per FIGS. 2 to 5).

A hydraulic ram (14, see FIG. 11) is housed within the casing tube (8) of the housing, being attached at its lower end adjacent to the base (4) of the housing so as to extend simultaneously along the axis of the guide bore of the casing tube, the guide bore of the outer bollard tube and the tubular internal bore of the inner bollard tube.

The head end of the hydraulic ram is detachably attached to the underside of the top plate (11) at the head end of the inner bollard tube.

An upper compartment (7) of the housing contains a hydraulic pump apparatus (not shown) operatively coupled to the hydraulic ram (14) by hydraulic transmission lines (not shown) which pass from the pump apparatus within the upper compartment to the hydraulic ram adjacent the base of the housing (4) via intermediate and lower conduits (9 and 10, respectively) connecting those upper and lower housing regions.

The effect upon the bollard assembly of operation of the hydraulic ram is illustrated by the sequence of FIGS. 1 to 5 as follows.

Figure 2:
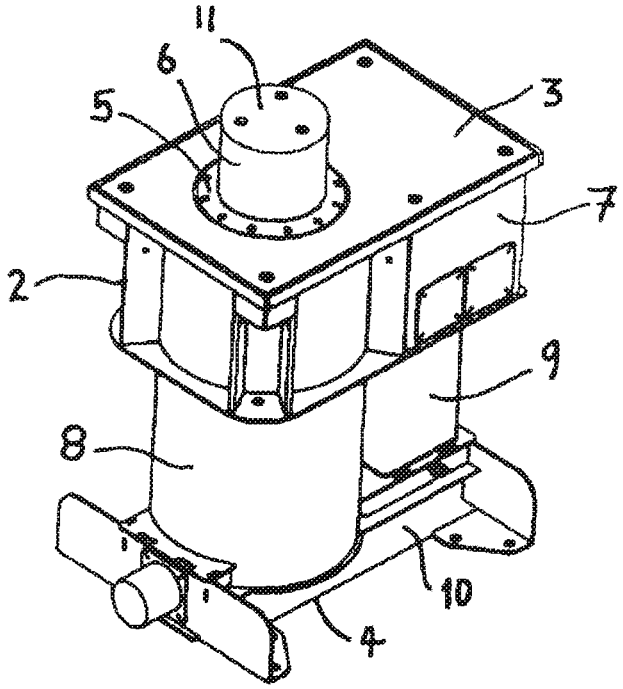
FIG. 2 illustrates a perspective view of a telescopic bollard assembly of FIG. 1 with a telescopic bollard in a partially extended state with the inner bollard tube partially extended and the outer bollard tube fully retracted.

In the quiescent state, the hydraulic ram is fully retracted (as per FIG. 11) within the housing and within the telescopic bollard tubes. The bollard tubes are fully retracted as shown in FIG. 1. Operation of the hydraulic pump apparatus to extend the telescopic bollard tubes causes the hydraulic ram to begin to urge upwardly towards the top plate (11) of the inner bollard tube to which it is attached, thereby to urge the upward sliding motion of the inner bollard tube along the guide bore of the outer bollard tube and outwardly of the top cover (3) of the housing as shown in FIG. 2 and FIG. 12. This represents a first stage of bollard tube extension. In which continued such urging movement by the hydraulic ram results in continued such sliding movement of the inner bollard tube.

Figure 3:
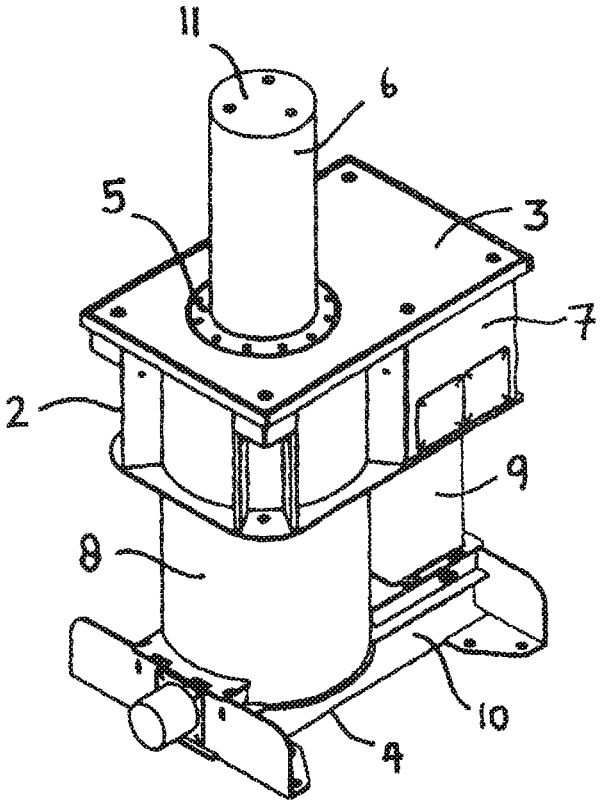
FIG. 3 illustrates a perspective view of a telescopic bollard assembly of FIG. 2 with a telescopic bollard in a partially extended state with the inner bollard tube fully extended and the outer bollard tube fully retracted.
Figure 13:
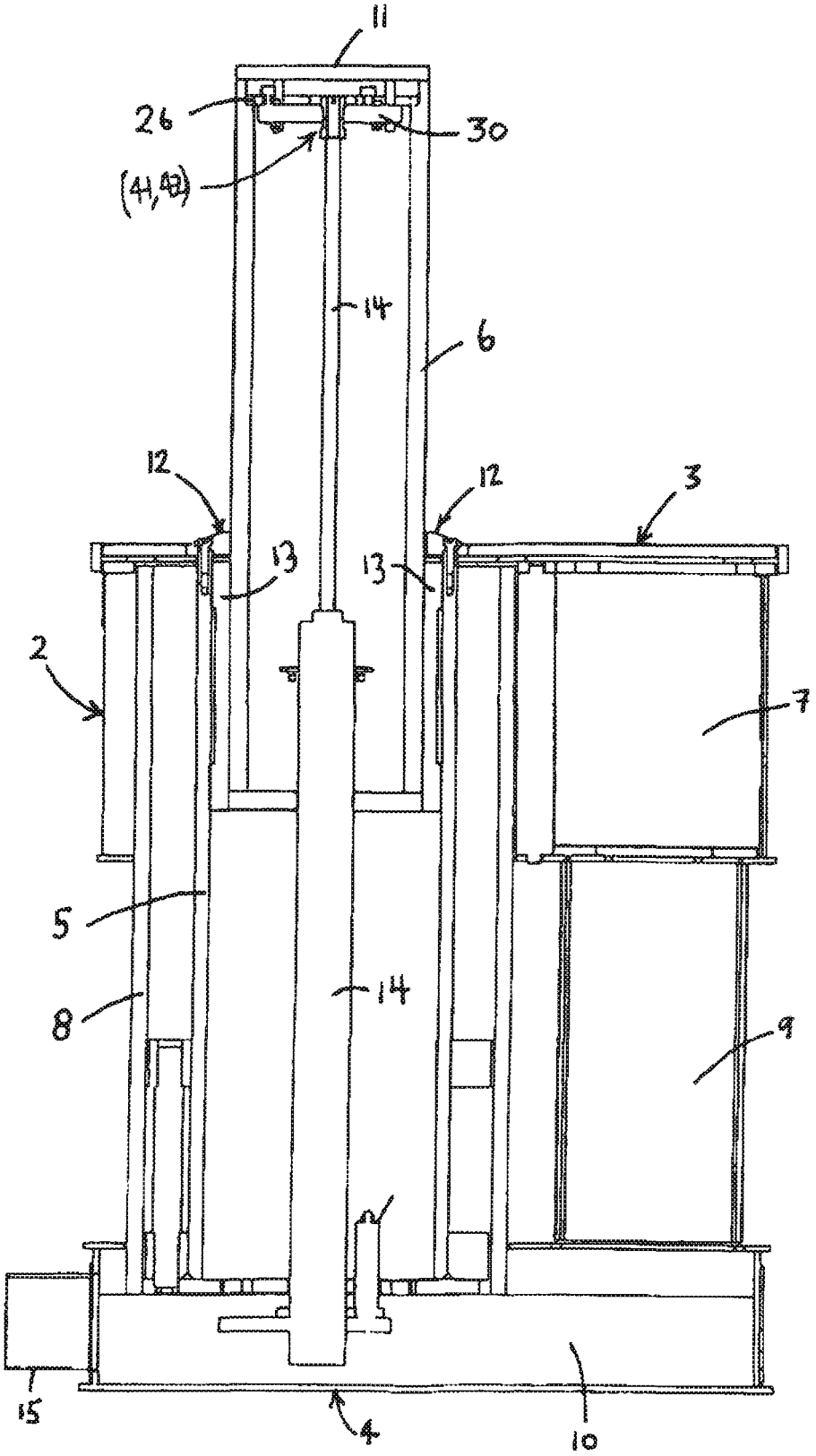
FIG. 13 illustrates a side cross-sectional view of the bollard assembly of FIG. 12, with the inner bollard tube fully extended and the outer bollard tube fully retracted.

FIGS. 3 and 13 both illustrate an intermediate state of bollard extension in which the inner bollard tube is fully extended relative to the outer bollard tube. The head end of the outer bollard tube terminates with a detachable stop ring assembly (12) which circumscribes the periphery of the guide bore of the inner bollard tube at the head end of the guide bore. The extreme outer diameter of the stop ring substantially matches, and is substantially flush with, the extreme outer diameter of the inner bollard tube (or may very slightly exceed and extend beyond it to form a circumferential lip). The extreme inner diameter of the stop ring is less than the extreme inner diameter of the guide bore of the outer bollard tube and substantially matches (most preferably being very slightly greater than) the extreme outer diameter of the inner bollard tube such that the inner bollard tube is able to freely move through the aperture defined by the stop ring.

An inner base collar (13) is attached to the inner bollard tube by an interference fit to the base end and lower parts of the outer tubular surface of the inner bollard tube. The head end of the inner base collar, where the inner collar terminates, defines a circumferential shoulder formation which circumscribes the outer tubular surface of the inner bollard tube around the axis of the inner bollard tube.

When in the intermediate state of extension, as shown in FIGS. 3 and 13, the shoulder formation defined by the inner base collar (13) of the inner bollard tube abuts the opposing underside of the stop ring (12) of the outer bollard tube. The result is that further extension of the inner bollard tube (6) relative to the outer bollard tube (5) is prevented. Continued operation of the hydraulic ram (14) urges the top end of the ram upwardly against the underside of the top plate (11) to continue to urge the inner bollard tube upwardly. This causes the shoulder formation at the inner bollard tube to urge upwardly against the opposing underside parts of the stop ring of the outer bollard tube (5) against which it is abutted thereby to urge the outer bollard tube (5) to slide upwardly with the inner bollard tube along the guide bore of the casing tube (8).

Figure 4:
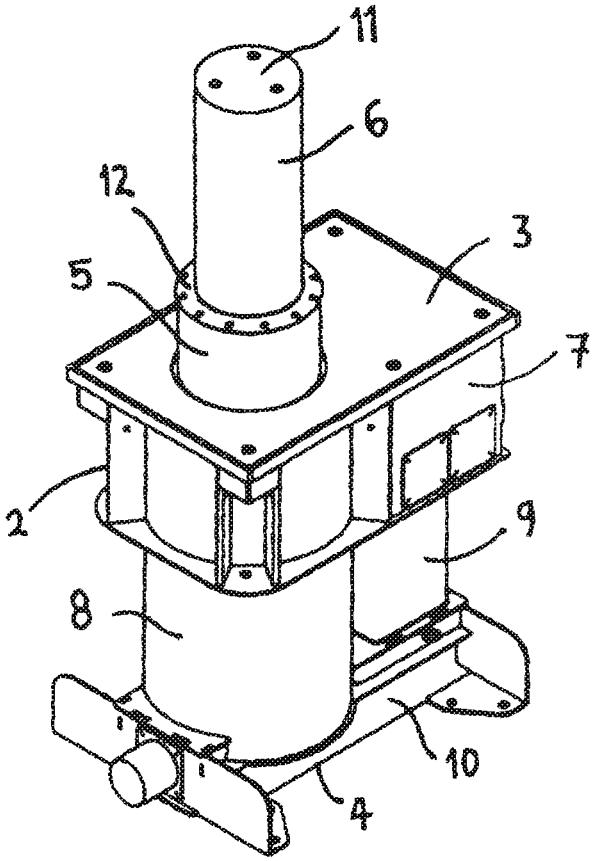
FIG. 4 illustrates a perspective view of a telescopic bollard assembly of FIG. 3 with a telescopic bollard in a partially extended state with the inner bollard tube fully extended and the outer bollard tube partially extended.
Figure 14:
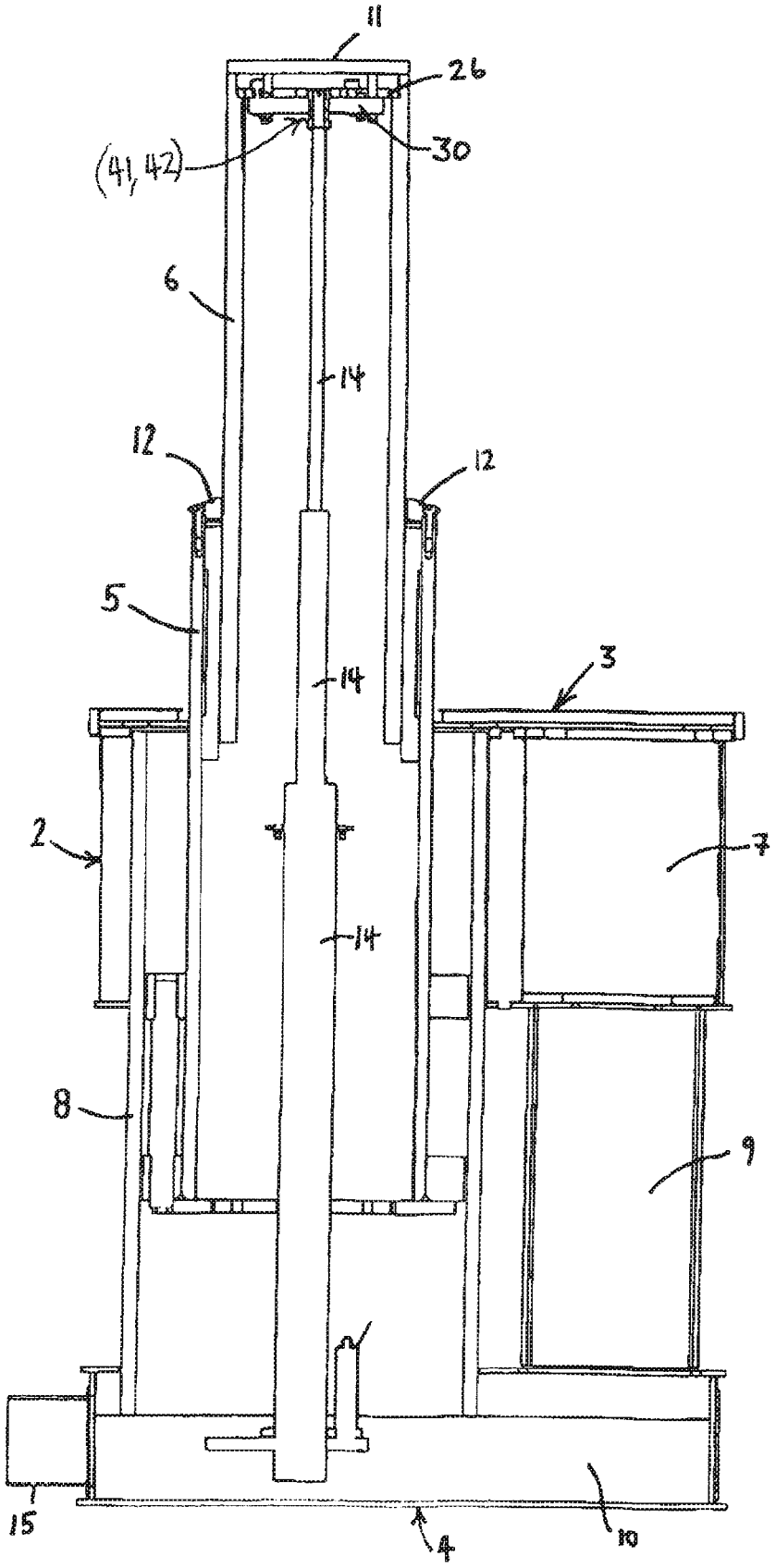
FIG. 14 illustrates a side cross-sectional view of the bollard assembly of FIG. 13, with the inner bollard tube fully extended and the outer bollard tube partially extended.

FIGS. 4 and 14 show the bollard apparatus in a second stage of extension in which continued such urging by the ram (14) in which the inner bollard tube continues to extend further from the housing top cover (3) of the bollard assembly, carrying with it the outer bollard tube.

Figure 5:
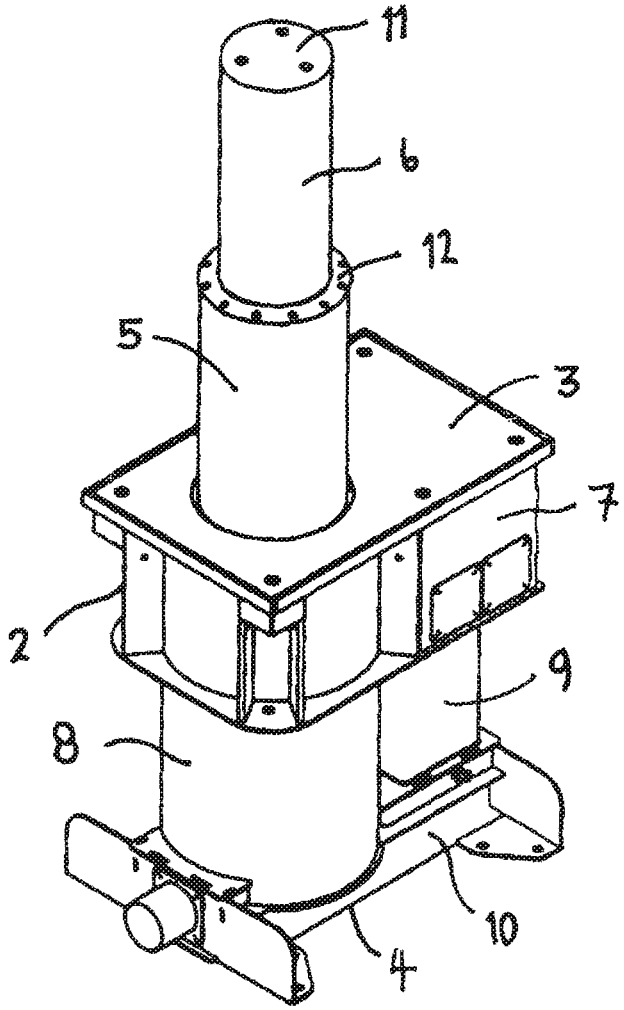
FIG. 5 illustrates a perspective view of a telescopic bollard assembly of FIG. 4 with a telescopic bollard in a fully extended state with the inner bollard tube fully extended and the outer bollard part tube extended.
Figure 15:
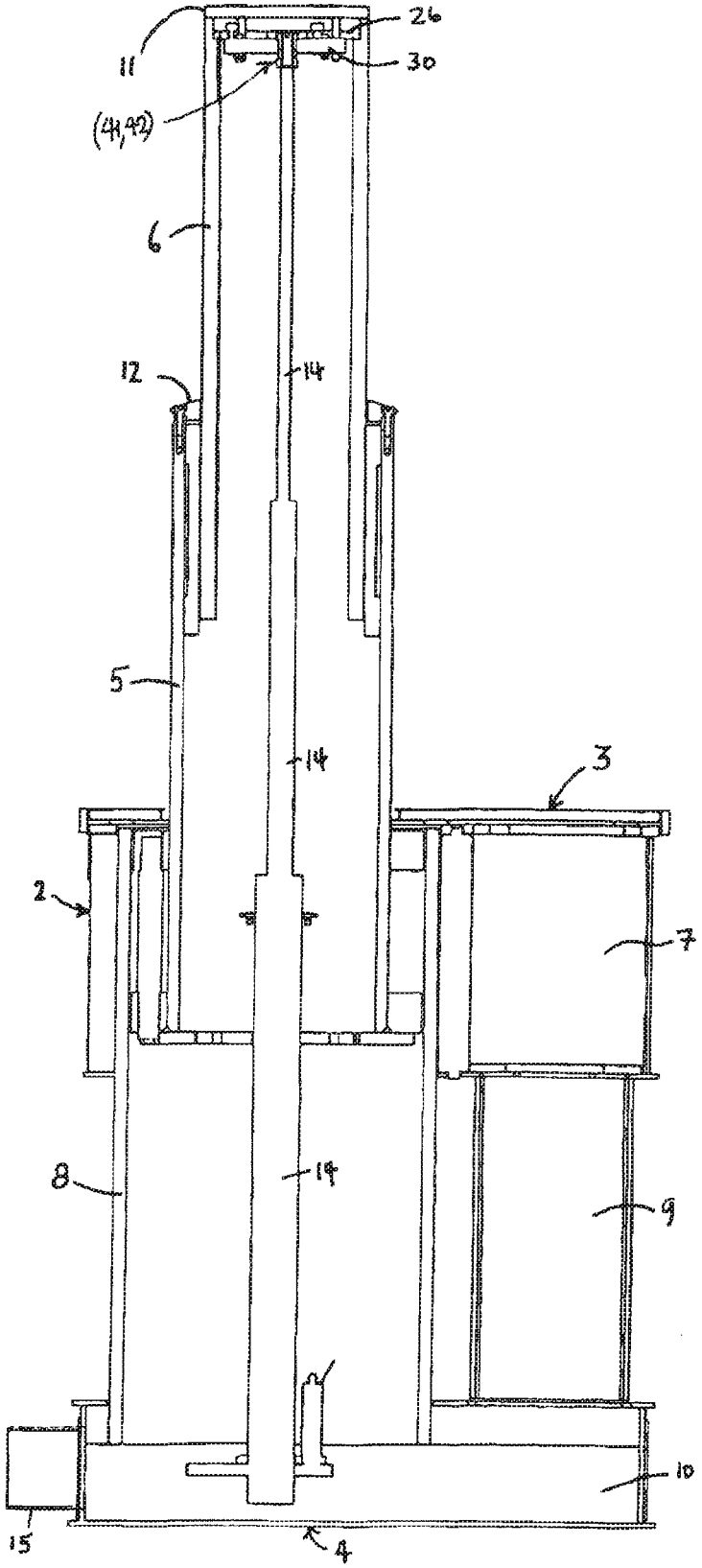
FIG. 15 illustrates a side cross-sectional view of the bollard assembly of FIG. 14, with the inner bollard tube fully extended and the outer bollard tube fully extended.
Figure 16A:
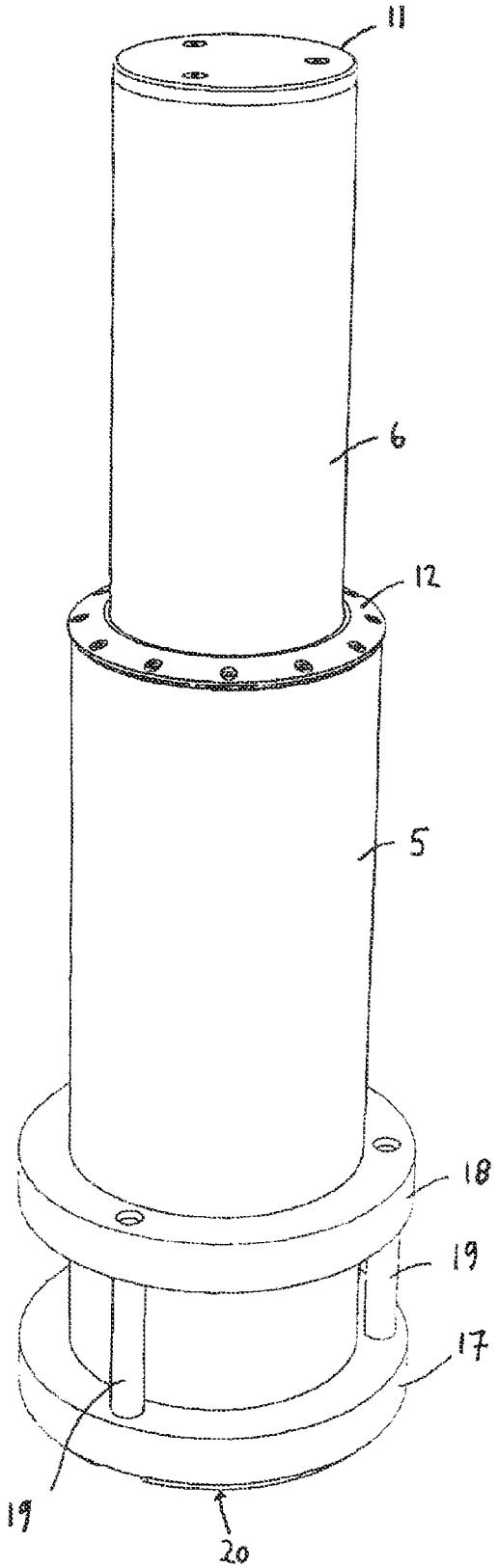
FIGS. 16A and 16B illustrate a base perspective view and a side view of the bollard tube apparatus of the bollard assembly of FIGS. 1 to 15 in isolation.

FIGS. 5 and 15 each show the bollard assembly with inner and outer bollard tubes fully extended. The outer bollard tube carries an outer base collard assembly (17, 18, 19 of FIG. 16A) attached to the base of the outer bollard tube by a few small welds (e.g. spot welds 22, FIG. 18) at the extreme terminal end of the outer bollard tube, other than at the curved cylindrical tube surface thereof. The outer base collar assembly comprises a pair of ring members (17, 18; FIG. 16A) each of which circumscribes the surface of the outer bollard tube at its outer surface. The two ring members are separated axially along the axis of the outer bollard tube by three separate column members (19, FIG. 16A) regularly spaced around the outer bollard tube which firmly fix the two ring members together in mutual aligned in parallel and in register axially.

The hydraulic ram (14) is maintained at a ram extension which positions the uppermost ring member of the outer collar assembly in contact with, or in immediate proximity to an opposing underside surface of the top cover (3) of the housing (2) which defines a circular through-opening having a diameter which exceeds the outer of the outer bollard tube—thereby to permit the outer bollard tube to pass therethrough—but which is less than the diameter of the guide bore of the bollard casing (8) with which it is in register. The result is that the edge of the through-opening extends partially over guide bore of the casing tube (8) at its periphery to act as a stop to prevent the upper collar member passing through the through-opening.

Figure 6:
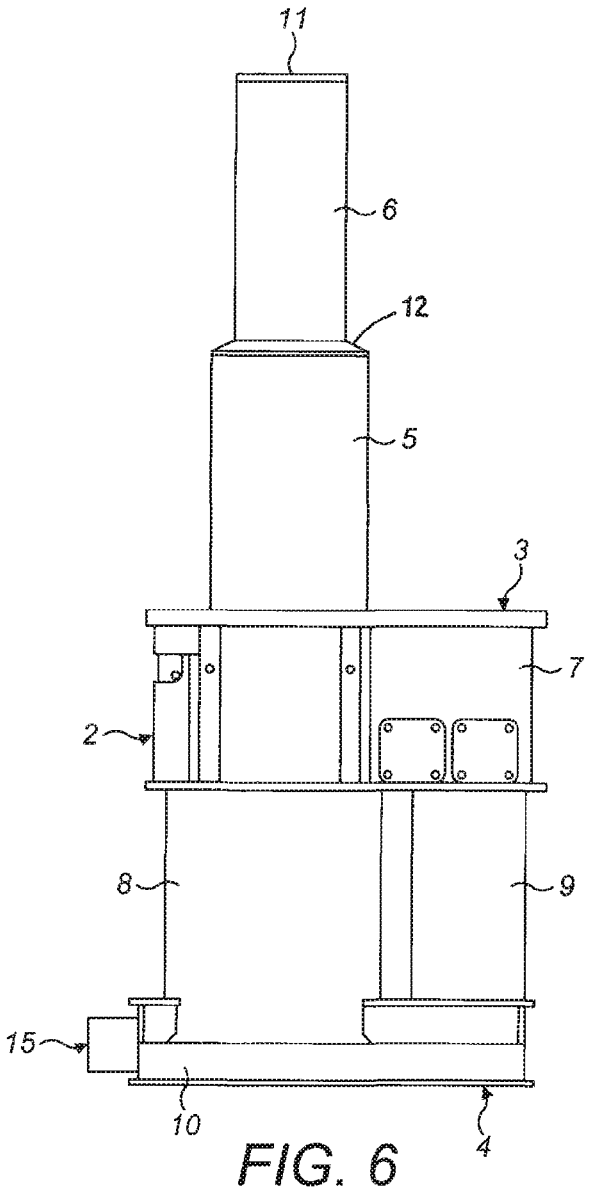
FIG. 6 illustrates a side view of the bollard assembly of FIG. 5, with the inner and outer bollard tubes fully extended.
Figure 7:
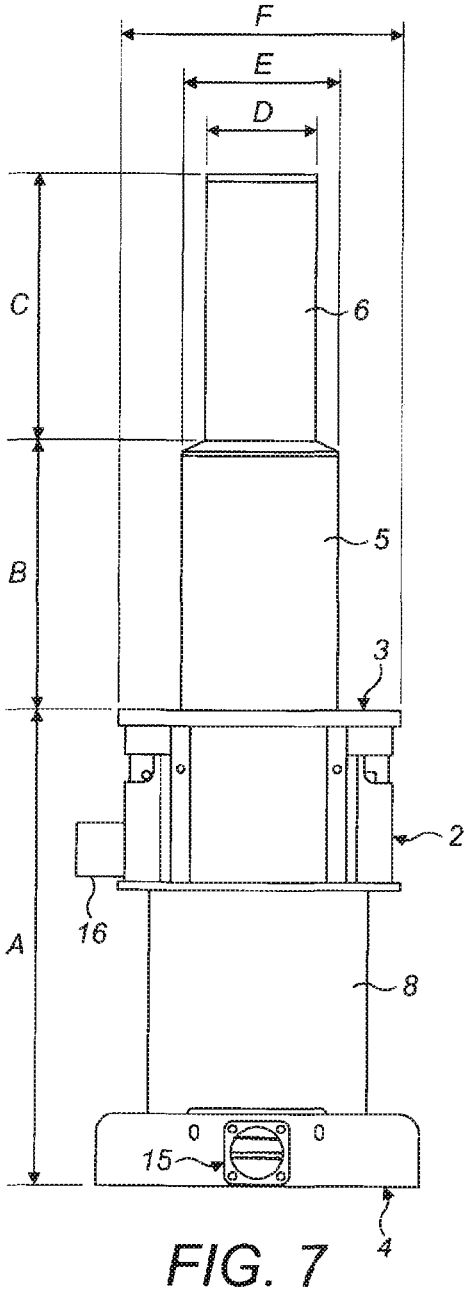
FIG. 7 illustrates a front view of the bollard assembly of FIG. 5, with the inner and outer bollard tubes fully extended.
Figure 8:
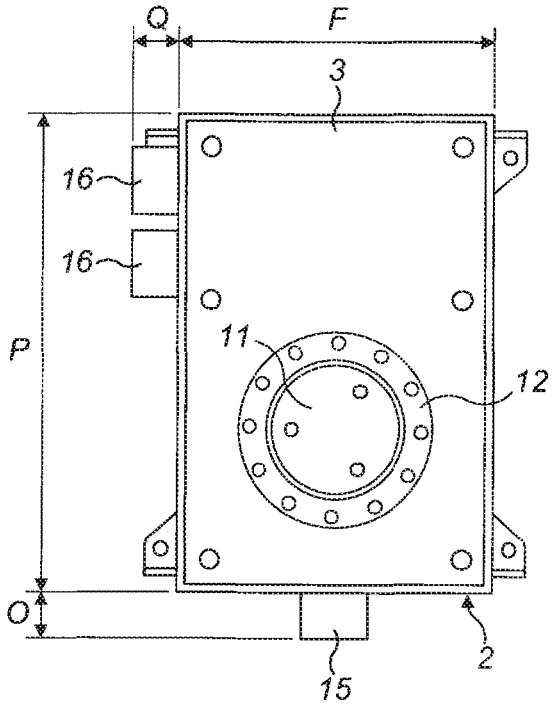
FIG. 8 illustrates a top view of the bollard assembly of FIG. 5, with the inner and outer bollard tubes fully extended.
Figure 9:
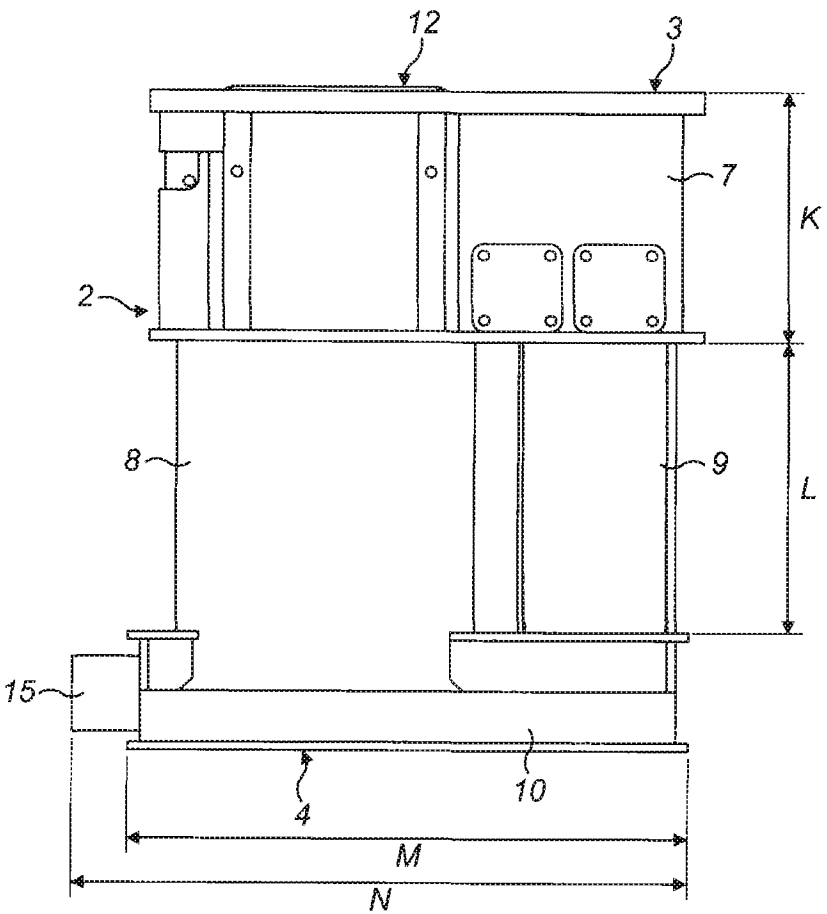
FIG. 9 illustrates a side view of the bollard assembly of FIG. 1, with the inner and outer bollard tubes fully retracted.
Figure 10:
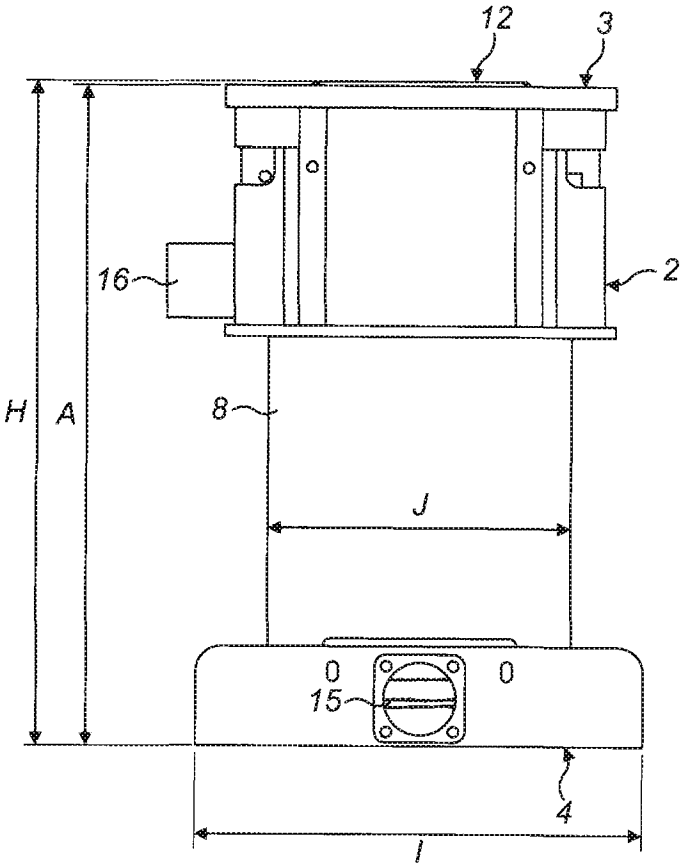
FIG. 10 illustrates a front view of the bollard assembly of FIG. 9, with the inner and outer bollard tubes fully retracted.

FIGS. 6, 7 and 8 show a side view, a front view and a top view, respectively, of the bollard assembly in the fully extended state. FIGS. 9 and 10 show a side view and a front view of the bollard assembly in the fully retracted state. Though not limited to particular dimensions, exemplary dimensions of parts of this particular example of the bollard assembly are identified as follows.

The height A of the housing is 900 mm. In the fully extended state, the outer bollard tube (5) extends to a height B of 500 mm above the top surface of the top cover (3) to the uppermost surface of the stop ring (12) of the outer bollard tube. The inner bollard tube (6) extends to a height C of 500 mm above the top surface of the stop ring (12) to the uppermost surface of the top plate (11) of the inner bollard tube (6). This means that the telescopic bollard tubes may collectively extend 1 m from the top of the housing when fully extended, yet the height of the housing is less than this.

The width F of the housing is 505 mm, whereas the outer diameter E of the outer bollard tube is 280 mm and the outer diameter D of the inner bollard tube is 209 mm. The length P of the top of the housing comprising the top plate (3), along a side, is 746 mm. This length slightly exceeds the length M of the very lowermost base of the housing which is 740 mm. A front duct (15) defines a cylindrical conduit of length O which is 76.5 mm and which surrounds a through-opening in a front wall of the lower conduit (10) of the housing at its base. The duct and through-opening are is adapted to admit power cable and/or hydraulic cable and/or drainage from the housing. The distance N from the tip of the front duct to the end of the housing base at its opposite end is 817.5 mm. Each one of an adjacent pair of side ducts (16) defines a cylindrical conduit of length Q=70 mm which surrounds a through-opening in a side wall of the upper compartment (7) of the housing. Each side duct and through-opening is adapted to admit power cable and/or hydraulic cable and/or drainage from the housing. The height L of the intermediate duct (9) is 406 mm while the distance K from the top of the intermediate duct to the top surface of the top plate (3), incorporating the height of the upper compartment (7) is 338 mm.

FIGS. 9 and 10 show the bollard assembly in the fully retracted state. The top plate (11) and stop ring (12) are substantially the only parts of the inner and outer bollard tubes exposed from the assembly housing (2). The uppermost surface of the stop ring is inclined, rising a distance of 10 mm from its outer ring diameter, which is flush with the top cover (3) of the housing, to its inner ring diameter, in the manner of a frustum, thereat to be flush with the top plate (11) of the inner bollard tube. The result is that the stop ring and top plate of the bollard tubes are raised slightly relative to the top cover (3) of the housing, and the overall height H of the bollard assembly, from lowermost base surface (4) to uppermost top plate surface (11) is 910 mm. The outermost diameter J of the casing tube (8) is 406.4 mm. The greatest transverse width of the housing base (4) is I=600 mm at the ends of the housing base where the housing base projects transversely from the body of the housing to define four foot projections—one at each rectangle corner of the housing base. Each of these four feet presents a through-opening through its base adapted to receive a pin or other fastening means (fastener) with which to pin or fasten the housing to the local ground surface at the base of an excavation (not shown) into which the housing is adapted to be embedded in use. By projecting beyond the width of the top cover (3) of the housing in use, the through-openings of the feet are accessible from above when the housing is in place within a ground excavation.

Reference is now made to FIGS. 16A to 19.

Figure 16B:
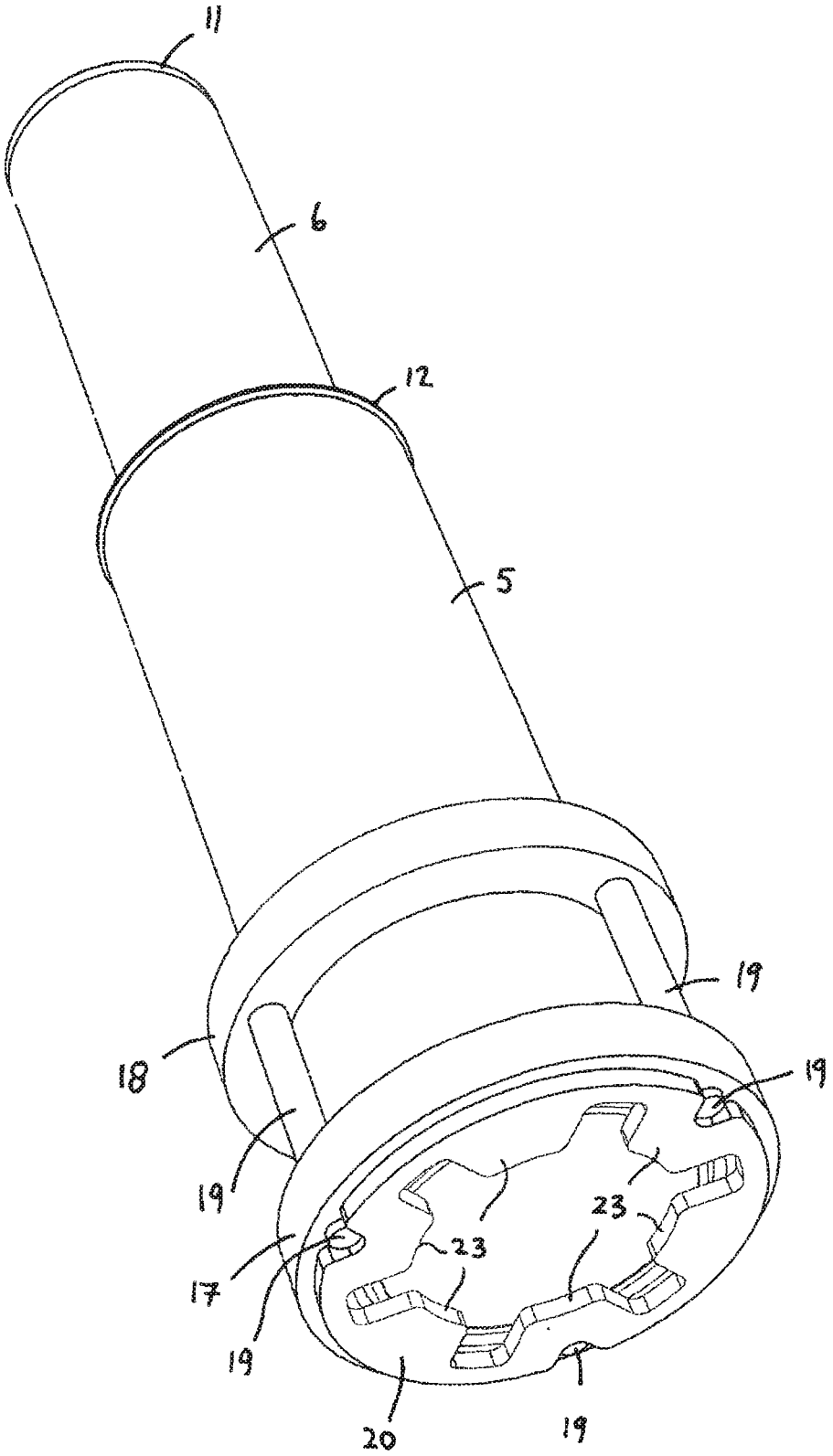

FIGS. 16A and 16B show two perspective views, one to a side the other to the base of the tube assembly and a base view of the fully-extended bollard tube assembly of the bollard apparatus comprising the inner bollard tube (6) housed at its base within the guide bore (24, FIG. 17) of the outer bollard tube (5). The top plate (11) sits atop the inner bollard tube, and the stop ring assembly (12) sits atop the outer bollard tube with the inner base collar (13, FIG. 17) abutted against its underside.

The outer base collar assembly (17, 18, 19) comprises a lower collard ring (17) which is attached to the base end (21) of the outer bollard tube by a plurality of small welds, such as spot welds (22) located within a circular channel formed between the extreme base end of the outer bollard tube and the inner terminal edge of the lower collard ring (17) of the lower collar ring. The circular channel circumscribes the guide bore of the outer bollard tube. It is formed by the meeting of the chamfered outer edge (21A) of the terminal tube surface of the outer bollard tube, and the opposing chamfered terminal edge (21B) of the inner diameter at the base of the lower collar ring in register with it. These two chamfered edges, axially aligned and in register, define opposite sloping channel walls of a V-shaped circular channel (21A, 21B). Consequently, the spot welds (22) may be formed upon, and between, the adjacent channel walls of the circular channel therewith to fix the lower collar ring, and outer base collar assembly, to the base of the outer bollard tube welding against the curved outer or inner walls of the outer bollard tube.

The three column members (19) each comprise a cylindrical column of common length having opposite column end portions of common diameter separating an intermediate column portion of greater diameter. The two column end portions of each column member are received intimately, respectively, within one of a pair of reciprocally dimensioned through-holes formed in the upper (18) and lower (17) collar rings of the outer base collar assembly, which are aligned in register. Since the diameter of the intermediate column portion of each column member exceeds the diameter of the through-holes in the upper and lower collar rings—against which the intermediate column portions are abutted—the result is that the upper and lower collar rings are evenly spaced from each other in parallel and in register with the outer bollard tube within them.

The upper and lower collar rings are of substantially the same shape and dimensions with the exception that only the lower collar ring presents a chamfered edge (21A) as described above, and the upper collar ring does not. The terminal end of each of the column members at the lower collar ring projects outwardly through the through-opening of the collar within which it is received, projecting beyond at the lowermost surface of the lower collar ring which faces in a direction away from the outer bollard tube and upper collar ring. The column members are each fixed to the lower collar ring by a spot weld (not shown) formed between the projecting terminal column end and the adjacent lowermost surface parts of the lower collar ring. The column members may be fixed to the upper collar ring (18) by an interference fit with the through-opening bore of a respective through-opening in the upper collar ring, or by a screw-thread fit therewith, or by welding (not shown).

A lower stop member (20) is welded to the lowermost surface of the lower collar ring (17) by a plurality of spot welds, or the like, (not shown). The lower stop member is shaped as a substantially flat and generally circular disc with a central aperture defining a through-opening through the disc. The shape of the aperture is such as to define a series of six radially inwardly projecting fin portions (23) dimensioned to project across the guide bore (24) of the outer bollard tube partially in a direction substantially perpendicular to the axis of the outer bollard tube. For example, each fin portion may project radially into the guide bore, transversely to the bore axis by a relative distance of about 10% of the diameter of the guide bore. Each such fin portion is opposed by one other such fin portion on the opposite side of the aperture with the result that the outermost 20% (of thereabouts) the guide bore diameter is occupied by those opposing fin portions (23). Consequently, the fin portions block movement of the inner bollard tube past the base end of the outer bollard tube (5) upon retraction of the inner bollard tube (6).

The housing part (2) in which the outer bollard tube is mounted in register with a base chamber of the housing part defined by the lower conduit (10) located between the base (4) of the housing part and the base end (21) of the outer bollard tube. The stop member projects across the guide bore partially so as to render parts of the guide bore (24) of the outer bollard tube in communication with the base chamber via the stop member. This means that detritus and rain water which enters the guide bore of the outer bollard tube may pass through the through-opening of the stop member and collect in the base chamber without collecting within the guide bore where it may interfere with the movement of the inner bollard tube (6) along the guide bore (24) of the outer bollard tube (5). Collected detritus within the base chamber may be drained out of the housing via the front duct (15) of the housing. Access to the base of the hydraulic ram (14), where the ram is attached to the housing (2) within the lower conduit, is also permitted through the aperture of the stop member to allow removal, servicing and maintenance of the ram.

Each one of the six fin parts (23) of the stop member (20) defines a seat against which the inner bollard tube assembly (particularly, its base collar 13) is arranged to rest when the inner bollard tube is in the fully retracted state. Thus, the retracted position of the inner bollard tube is defined. Should the hydraulic ram fail, and the inner bollard tune fall into the guide bore of the outer bollard tube, it will come to rest at the stop member such that the top plate of the inner bollard tube is flush with the uppermost part of the outer bollard tube (i.e. the stop ring 12) as desired. The inner bollard tube is prevented from falling it to the base chamber and prevents the guide bore of the outer bollard tube from becoming exposed at the top of the bollard assembly (3). In this way, the stop member defines the terminal end of the guide bore.

The hydraulic ram is attached to the housing at its other end within the base chamber defined by the lower conduit (10). It extends upwardly past the stop member and in to the outer bollard tube and thence the inner bollard part. The hydraulic ram extends along the inner bollard tube to which it is attached at its uppermost terminal end via the top plate (11). The hydraulic ram is operable to retractably extend along the guide bore of the outer bollard part to urge the inner bollard part between a retracted state and an extended state.

The outer bollard tube is slidingly housed within the casing tube (8) of the housing (2) so as to be slidingly moveable relative thereto between a telescopically retracted state in which substantially all of the length of the outer bollard tube resides within the housing, and a telescopically extended state in which relatively less of the length of the outer bollard tube resides within the housing and relatively more of its length extends beyond the housing. The radially outermost curved surfaces of the lower and upper collar ring part (17, 18) define a sliding interface between the outer bollard tube assembly and the inner reciprocally curved surface of the guide bore of the casing tube (8). The radii of curvature of the interfacing collar ring surfaces and the casing tube guide bore substantially match. The use of the circular collar ring outer surfaces as the sliding interface with the guide bore of the casing tube protects the outer tubular surface of the outer bollard tube from damage through abrasion and wear which would otherwise occur were it in direct sliding contact with the guide bore surface. Spacing the two base collar rings (17,18) using the column members (19) inhibits undesirable inclination if the outer bollard tube relative to the axis of the guide bore of the casing tube (8). In particular, a transverse force applied to exposed parts of the outer bollard tube may typically generate a torque which may cause the outer bollard tube to urge to pivot about a fulcrum defined by the upper base collar ring (18). A reactive, resistive force is then generated by the surface of the guide bore of the casing tube (8) against which the interfacing surface of the lower ring (17) of the base collar is consequently urged. The greater the ring spacing provided by the column members (19), the proportionally less will be the reactive force required to be generated by the guide bore surface in order to resist the torque so generated. The ring spacing may be selected accordingly. Additional collar rings may be employed.

Consequently, the bollard assembly comprises a casing tube guide bore, and an outer bollard tube housed within that guide bore so as to extend therealong from a base end (21) of the bollard tube so as to be slidingly moveable along the guide bore between a retracted state in which substantially all of the length of the outer bollard tube resides within the casing tube guide bore, and an extended state in which relatively less of the length of the outer bollard tube resides within the casing tube guide bore and relatively more of its length extends from that guide bore. The outer base collar assembly is fixed to the base end of the outer bollard tube and is positioned between an outer tubular curved surface of the outer bollard part and an opposing curved inner bore surface of the guide bore. A sliding interface is formed therebetween. The collar assembly is fixed to the base end (21) of the outer bollard part by welds at other than those opposed outer tube and guide bore curved surfaces. The upper and/or lower collar rings may also form an interference fit with the outer curved surface of the outer bollard tube they embrace.

Figure 11:
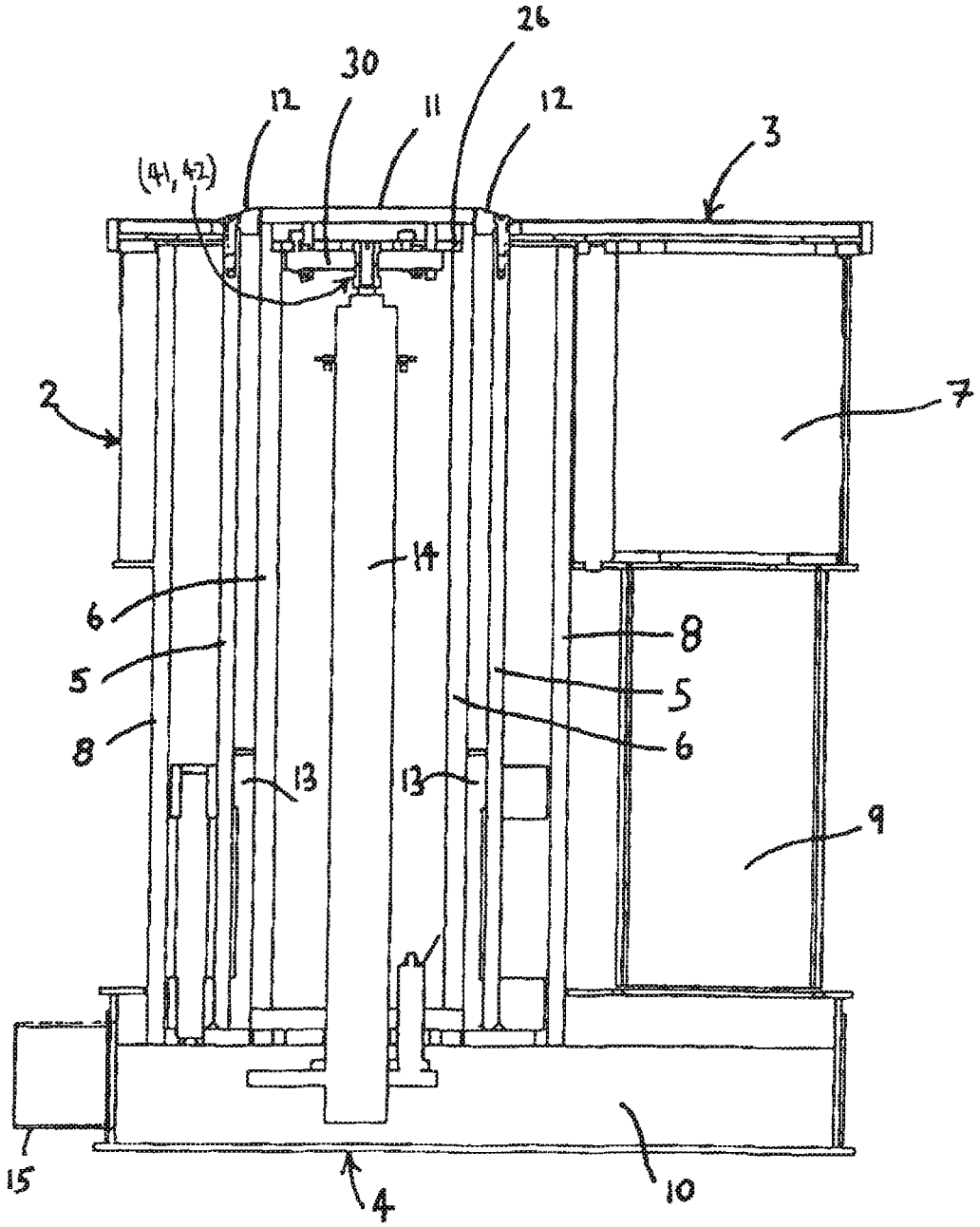
FIG. 11 illustrates a side cross-sectional view of the bollard assembly of FIG. 9, with the inner and outer bollard tubes fully retracted.
Figure 12:
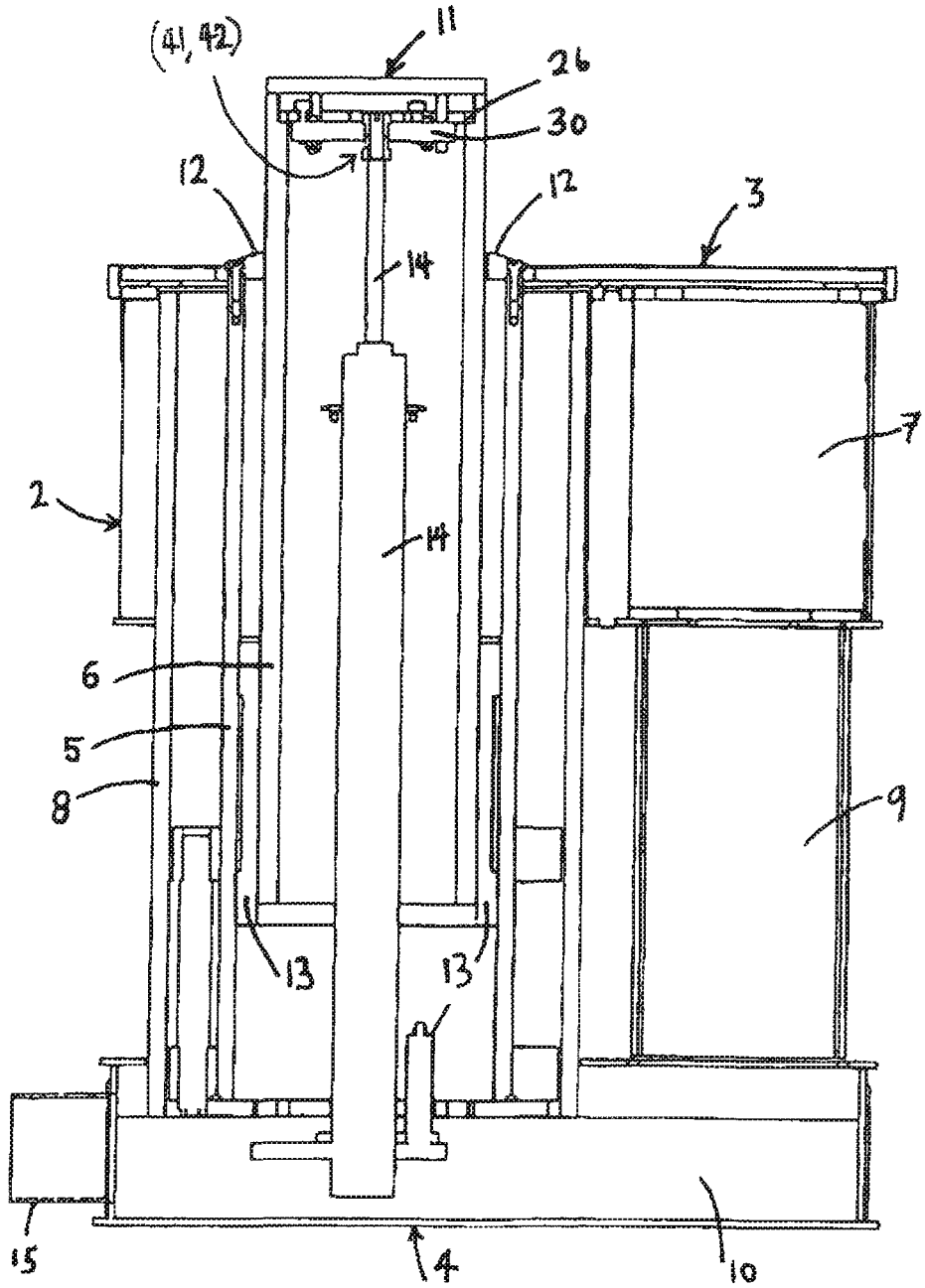
FIG. 12 illustrates a side cross-sectional view of the bollard assembly of FIG. 11, with the inner bollard tube partially extended and the outer bollard tube fully retracted.

The stop member (20) is arranged to rest upon one or more abutment parts (not shown) of the housing within the base chamber defined by the lower conduit (10) when the outer bollard part in its fully retracted state as shown in FIG. 11. This places the stop member above the base parts of the hydraulic ram.

Figure 17:
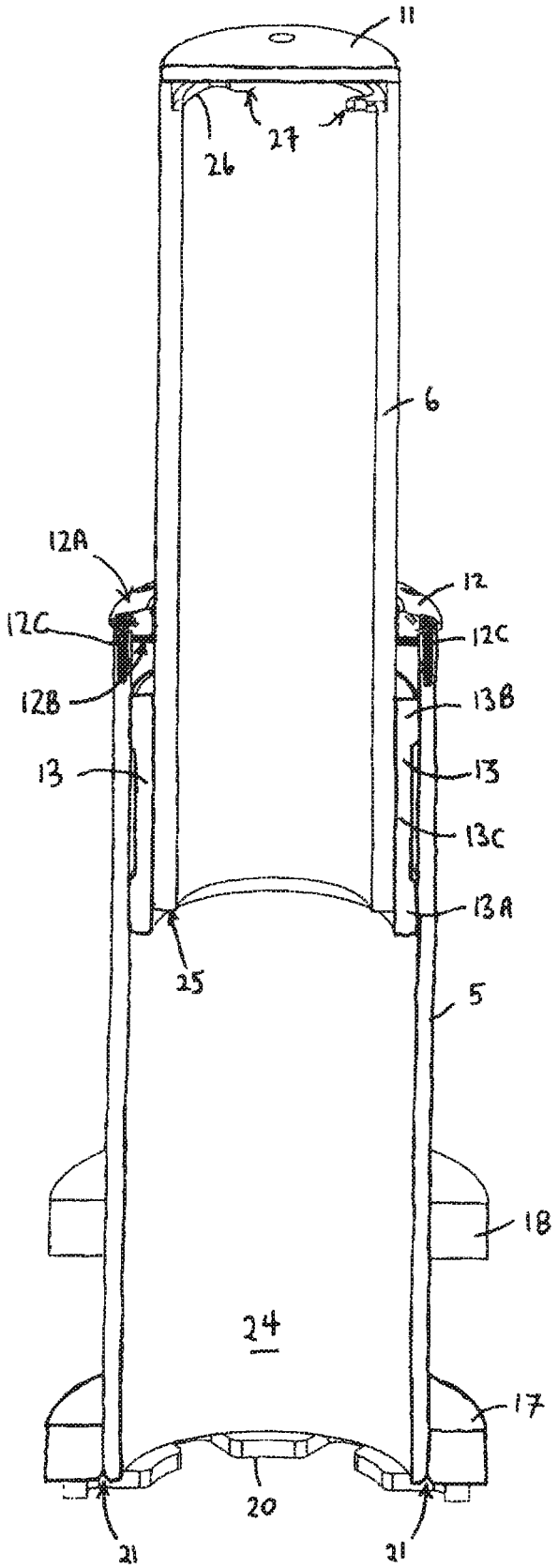
FIG. 17 illustrates a side cross-sectional view of the bollard tube apparatus of the bollard assembly of FIG. 16.
Figure 18:
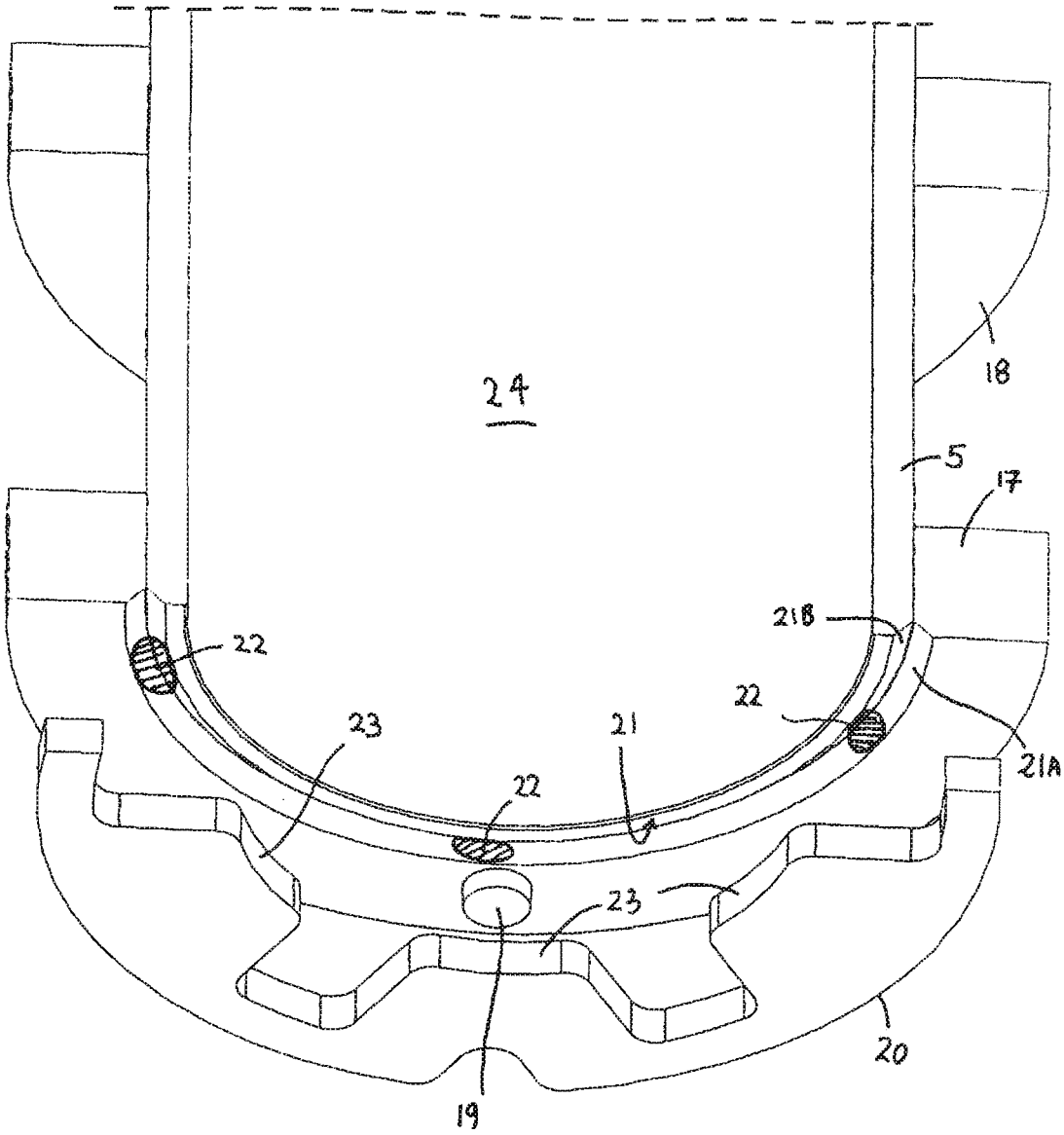
FIG. 18 illustrates an exploded base cross-sectional view of the bollard tube apparatus of the bollard assembly of FIG. 17.
Figure 19:
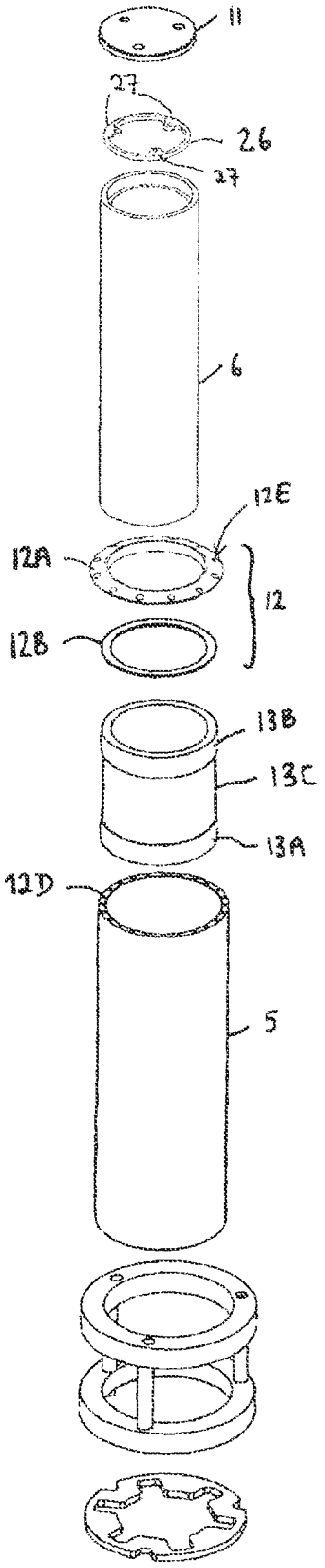
FIG. 19 illustrates an exploded view of the bollard tube apparatus of the bollard assembly of FIG. 16.

FIGS. 17 and 19 illustrate a cross-sectional view and an exploded view, respectively, of the telescopic bollard tube assembly illustrated in FIGS. 16A, 16B and 18.

The guide bore of the outer bollard tube contains at least a part of the inner bollard tube (6) housed within it so as to extend therealong from a base end (25) of the inner bollard tube to the top plate (11) thereof. The inner bollard tube is slidingly moveable along the guide bore of the outer bollard tube between a telescopically retracted state in at least some of the length of the inner bollard tube resides within the guide bore of the outer bollard tube, and a telescopically extended state in which relatively less of the length of the inner bollard part resides within the guide bore of the outer bollard tube and relatively more of said length extends from that guide bore.

An inner base collar member (13) is fixed around the base end (25) of the inner bollard tube and is positioned between the outer tubular curved surface of the inner bollard tube and an opposing inner tubular curved surface of the guide bore of the outer bollard tube, to form a sliding interface therebetween.

The inner base collar member (13) extends along the outer curved tubular surface of the inner bollard tube from a lower collar portion (13A) to an upper collar portion (13B) via an intermediate waist portion (13C) of the collar member. These collar portions form integral parts of a tubular collar member having a uniform inner tubular diameter adapted to present an inner collar surface forming along its length an interference fit with the opposing outer tube surface of the inner bollard tube. The outer diameter of the inner base collar member is not uniform, being lesser at the intermediate waist portion and uniformly greater at each of the lower and upper collar portions ion common. Each of the lower and upper collar portions forms the sliding interface with the guide bore of the outer bollard tube, but the waist portion between them does not as it is recessed from (and so not in contact with) the guide bore surface.

The inner base collar member is fixed to the inner bollard tube by an interference fit with the outer curved tubular surface parts thereof adjacent the base end (25) of the inner bollard tube. Optionally one or more welds located at that base end may be applied, avoiding the curved tubular surfaces of the inner bollard tube. Thus, no welding is applied to the outermost curved surface (walls, sides or flanks) of the inner bollard part, or of the outer bollard part. It is to be noted that the outer base collar assembly (17, 18, 19) described above may also take the form of the inner base collar member (13) in alternative embodiments.

The radii of curvature of the interfacing surfaces of the lower and upper collar portions (13A, 13B) substantially match that of the guide bore of the outer bollard tube. Thus, the lower and upper collar portions are circular on cross-section and define radially outermost surfaces which serve as the sliding interface with the guide bore of the outer bollard tube. This protects the outer tubular surface of the inner bollard tube from damage through abrasion and wear which would otherwise occur were it in direct sliding contact with the guide bore surface of the outer bollard tube. Spacing the two inner base collar portions (13A,13B) using the intermediate waist portion (13C) inhibits undesirable inclination if the inner bollard tube relative to the axis of the guide bore (24) of the outer bollard tube (5). In particular, a transverse force applied to exposed parts of the inner bollard tube may typically generate a torque which may cause the inner bollard tube to urge to pivot about a fulcrum defined by the upper collar portion (13B) of the inner base collar member (13). A reactive, resistive force is then generated by the surface of the guide bore of the outer bollard tube (5) against which the interfacing surface of the lower collar portion (13A) of the inner base collar member is consequently urged. The greater the spacing between lower and upper collar portions that is provided by the intermediate waist portion (13C), the proportionally less will be the reactive force required to be generated by the guide bore surface in order to resist the torque so generated. The spacing between lower and upper collar portions may be selected accordingly. Additional collar portions, and accompanying intermediate waist portions, may be employed.

The stop ring assembly (12) of the outer bollard tube comprises a top ring (12A) having an outer diameter slightly exceeding the outer diameter of the outer bollard tube (5), and an inner diameter which is less than the diameter of the guide bore of the outer bollard tube and slightly exceeds the outer diameter of the inner bollard tube. The axis of symmetry of the top ring is coaxial with the axis of the guide bore of the outer bollard tube. The stop ring assembly projects across the guide bore in a direction substantially perpendicular to the axis of the outer bollard tube. As a consequence, the aperture of the top ring permits the inner bollard tube (6) to pass therethrough but prevents passage of the upper collar portion (13B) of the inner base collar member (13) attached to the base of the inner bollard tube. The top ring is attached to the top end of the guide bore of the outer bollard tube by a plurality (e.g. twelve) of bolts (12C) which are securable to threaded bolt holes (12D) arranged within the terminal top end of the guide bore of the outer bollard tube (5). There are a corresponding plurality (e.g. twelve) of bolt-receiving apertures (12E) arranged at regular intervals around the top ring and these correspond to a first set of corresponding said bolt holes arranged in the terminal top end of the guide bore such that each of the former apertures may be arranged mutually in register with each of the latter bolt holes in unison. A second array of (e.g. twelve) bolt holes arranged in an array also to permit each of the former apertures (12E) to be arranged mutually in register with each of the bolt holes (12D) of the second array in unison should one or more of the bolt holes of the first array become damages (e.g. threading stripped). The second array of bolt holes serves as a spare set which can be accessed by rotating the top ring to bring the bolt-receiving apertures of the top ring and the bolt holes of the spare set of bolt holes into register.

A buffer ring (12B) is attached to the lower surface of the top ring and faces towards the upper surface of the upper collar member (13B) of the inner base collar member (13) fixed to the base of the inner bollard tube. When the latter abuts the stop ring assembly (12) as the inner bollard tube rises to its maximum extension from the outer bollard tube and subsequently urges extension of the outer bollard tube (see FIGS. 13 and 14) the buffer ring (12B) acts as a shock-absorbing means (shock absorber) to absorb impact energy during that impact process. The hydraulic ram (14) is operable and arranged to retractably extend along the guide bore of the outer bollard tube to move the inner bollard tube to urge the top of the inner base end collar (13) against the buffer ring of the stop ring thereby to urge the outer bollard tube to move slidingly relative to the guide bore of the casing tube (8). The bollard assembly is arranged to drive the hydraulic ram to extend at a rate of extension which falls as the inner base end collar (13) approaches the stop ring (12). In this way, the hydraulic ram is preferably driven so as to reduce in speed of extension as the impact in question is about to take place so as to reduce impact energy, and to increase in speed after the impact has occurred. The buffer ring may be made of any suitable shock-absorbing material, such as a rubber material, or an elastomeric material of the like. The outer diameter of the buffer ring substantially matches the diameter of the guide bore of the outer bollard tube (5) and is inserted into the end portion of the guide bore upon a ring-shaped flange formed at the underside of the top ring correspondingly dimensioned. The inner diameter of the ring-shaped flange corresponds to the inner diameter of the top ring, which is slightly less than the outer diameter of the inner bollard tube.

However, the inner diameter of the buffer ring matches the outer diameter of the inner bollard tube and presses against the outer surface of the inner bollard tube to as to act as a wiping member which wipes the outer surface of the inner bollard tube as it moves relative to the outer bollard tube and the stop ring atop it. This helps prevent detritus from entering the guide bore of the outer bollard tube by being carried in to the guide bore upon the outer surface of the inner bollard tube as the former retracts in to the latter.

Thus, the outer bollard tube includes a detachable stop ring at its head end against which the base end parts (i.e. inner base end collar 13) of the inner bollard tube are arranged to urge when the inner bollard tube is moved to an extended state such that the outer bollard tube is urged to move slidingly relative to the housing (2). The stop ring is detachable to permit movement of the base end of the inner bollard tube past the head end and out of the guide bore of the outer bollard tube. This allows ease of disassembly for the purposes of servicing and maintenance and the like.

The views of FIGS. 17 and 19 illustrate elements of the inner bollard tube in cross-sectional form and in exploded view, respectively. The tubular bore of the inner bollard tube (6) a is substantially uniform in diameter from the base of the inner bollard tube to a stepped portion adjacent to the top end of the bollard tube at which the bore diameter steps to an increased size thereby defining a step or ledge upon which is located a top coupling ring (26) housed in an intimate fit with the inner bore surface of the inner bollard tube at between the step and the extreme terminal upper end of the tube bore.

The top coupling ring (26) may be fixed to the inner bore of the inner bollard tube (6) by welding, threading or by an interference fit therewith.

A plurality (e.g. three in this example) of separate stop flanges (27) extend radially inwardly towards the central axis of the top coupling ring from the inner diameter of the top coupling ring. This axis coincides with the axis of the bore of the inner bollard tube. The stop flanges extend in to the bore of lesser diameter of the inner bollard tube in a direction perpendicular to its axis. Each stop flange has a through-opening passing from the uppermost surface to the lowermost surface thereof, being dimensioned to receive a coupling bolt therethrough for coupling the coupling ring to an interface assembly (30, FIG. 20) to which the uppermost end of the hydraulic ram (14) is coupled, thereby the couple the hydraulic ran to the top end of the inner bollard tube internally.

The housing (2) of the bollard assembly (1) thus comprises a hollow inner bollard tube mounted therein to be slidingly moveable relative to the housing, and a hydraulic ram actuator (14) arranged within the hollow of the inner bollard tube to urge the bollard tube to move relative to the housing from a retracted state unsupported by the hydraulic actuator in which substantially the length of the inner bollard tube resides within the housing, to an extended state supported by the hydraulic actuator in which relatively less of the length of the inner bollard tube resides within the housing and relatively more of its length extends beyond the housing part. The separate fixed stop flanges (27) of the top coupling ring (26) extend in to the hollow bore of the inner bollard tube between the top plate (11) at the head of the inner bollard tube and the hydraulic ram actuator.

A detachable interface assembly (30) is shown in FIGS. 20 to 23 and in FIGS. 11 to 15. The interface assembly is arranged within the hollow bore of the inner bollard tube between the stop flanges (27) of the top coupling ring (26) and the hydraulic ram actuator (14) so as to abut the stop flanges and to be abutted by the hydraulic ram actuator to permit the hydraulic ram actuator via the interface assembly to support the inner bollard tube at the stop flanges in the extended state.

The hydraulic ram actuator is operable to disengage from the interface assembly (30) when the inner bollard tube and the outer bollard tube are both in the retracted state and neither is supported by the hydraulic ram actuator, thereby to permit the interface assembly to separate from the stop flanges (27) so as to allow the interface assembly to be detached therefrom to enable access to the hydraulic ram actuator within the hollow bore of the inner bollard tube.

The bollard assembly illustrated in FIGS. 11 to 15 comprises a housing containing a hollow inner bollard tube mounted therein to be slidingly moveable relative to the housing, and the hydraulic ram actuator (14) arranged within the hollow of the inner bollard tube to urge the inner bollard tube to move relative to the housing. This movement is between a retracted state unsupported by the actuator in which at least some of the length of the inner bollard tube resides within the housing, and an extended state supported by the actuator in which relatively less of the length of the inner bollard resides within the housing and relatively more of its length extends beyond the housing part. A top coupling ring (26) is attached to the top end of the inner bollard tube in register with the axis of the bore of the inner and outer bollard tubes. It is seated within a circumferential ledge formed at the top of the bore of the inner bollard tube by a stepped increase in the bore diameter. The three stop flanges (27, FIG. 19) each extend radially inwardly of the top coupling ring and extend partially into the hollow bore of the inner bollard towards its axis between the head of the bollard and the actuator. The detachable interface assembly (30) is arranged within the hollow of the bollard part between the top coupling ring and the actuator part to abut the stop flanges of the top coupling ring and to be abutted by the actuator to permit the actuator via the interface assembly to support the inner bollard tube at the top coupling ring in the extended state. The actuator is operable to disengage from the interface assembly when the inner bollard tube is in the retracted state to permit the interface assembly to separate from the stop ring to be detached therefrom to enable access to the actuator within the hollow of the inner bollard tube.

Figure 20:
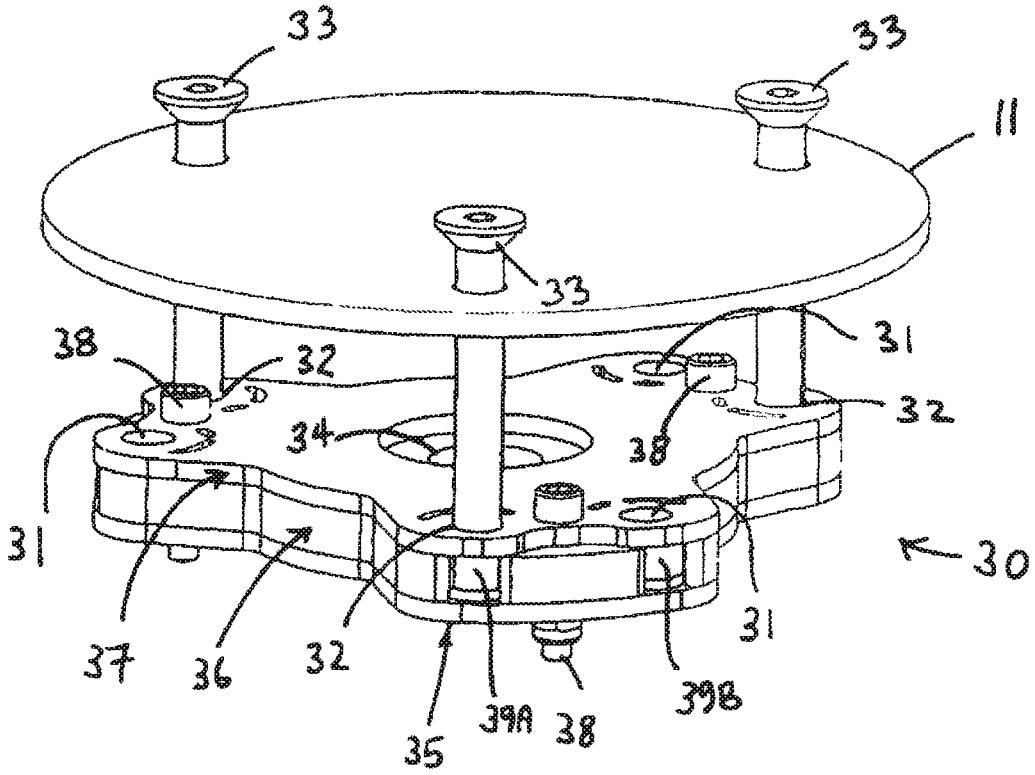
FIG. 20 illustrates a view of an interface assembly attached by three bolts to a top plate of the bollard assembly of FIG. 19.

FIG. 20 illustrates the interface assembly (31) which is also shown in position within the bollard apparatus illustrated in cross-sectional form FIGS. 11 to 15.

The interface assembly comprises a lower holding plate (35) and an upper holding plate (37) of substantially the same shape and form arranged in parallel and in register, and sandwiching between them a nut-holder plate (36). The three plates share a generally common peripheral edge shaping dimensioned to each be flush in common to provide a generally unified side shaping to the interface assembly. This shaping defines three concavities in the shape of the peripheral edge/sides of the assembly separated by three load-bearing portions within each of which is formed a pair of through-openings (31, 32).

This assembly of three plates is held together by three nut-and-bolt arrangements (38) passing through a respective one of three through-openings passing through three-plate laminate at one of three locations upon the interface assembly equidistant from each other. Each of these through-openings (32) is dimensioned to accept the shaft of a respective attachment bolt (33) via which the head plate (11) of the bollard assembly, for covering-over the bore/hollow of the inner bollard tube at the top, is attached to the interface assembly.

Three separate through-openings (32, 40A, FIG. 21) are formed in register through the upper and lower holding plates and in the edge of the intermediate nut-holding plate (36) passing therethrough. The through-openings in the nut-holding plate are hexagonally shaped in order to reciprocally match and correspond to the outer hexagonal shape of a respective hexagonal nut (39A) which is adapted and arranged to interface with the external threading of a connector bolt (33) passing in to the respective through-openings in the interface assembly. These three through-openings in register collectively define one through-opening in the interface assembly. In this way, the interface assembly is attached to the top/cover plate (11) of the bollard assembly by each one three bolts (38).

The interface assembly has six such common through-openings spaced around the assembly adjacent to its edge. Located adjacent to any one through-opening of the interface assembly (32, 40A) is another such assembly through-opening (31, 40B) which contains a further hexagonal nut (39B) seated within a correspondingly shaped hexagonal through-opening (40B) in the edge of the intermediate nut-holding plate (36). In this way, the interface assembly comprises six through-openings of this type grouped as three separated and equidistant pairs.

The stop ring (26) possesses three of the aforementioned stop flanges (27, FIG. 19) each of which has within it a through-opening adapted to receive a threaded bolt. The threaded bolt (not shown) is adapted to engage a respective one of the three hexagonal nuts (39B) located within a respective one through-opening of the three separated pairs (40A, 40B) of through-openings of the interface assembly.

The circumferential arrangement of the stop flanges (27) about the top coupling ring is such as to cooperate with, and match, the circumferential position of one through-opening (31) in each of the three through-opening pairs of the interface assembly. The extent of the concavities in the edge of the interface assembly is such that the interface assembly may be rotated about the axis of the bore of the inner bollard tube from as position in which it engages simultaneously with each one of the three stop flanges, to a position in which it engages with none of them. In the latter position, each one of the three stop flanges is positioned above a respective one of the three concavities in the edge of the interface assembly. The respective concavities are of sufficient depth that a respective stop flange does not obstruct the lifting upwards of the interface assembly through the top coupling ring and out of the bollard tube when the interface assembly is also decoupled from the end of the hydraulic actuator (14).

When any one of the through-openings of the interface assembly is positioned in register with a through-opening of a stop flange (27) of the top coupling ring, so to is each one of a further two through-openings of the interface assembly with respect to the other two through-openings in the remaining two stop flanges. The interface assembly is positioned underneath the top coupling ring against the three stop flanges, in register with them, and fixed thereto by fixing bolts which pass through the through-openings of the stop flanges and the through-openings of the interface assembly to engage the hexagonal nuts (39A) held therein.

A terminal top end of the actuator (41, 42) is adapted to engage with the interface assembly and, via the interface assembly, engage with the top coupling ring and the top of the inner bollard tube.

A central through-opening (34, 34A, 34B) passes through the centre of the interface assembly. The through-opening is formed by a through-opening (34A) in the upper holding plate (37) of the interface assembly, a through-opening in the lower holding plate (35) of the interface assembly and a central through-opening (34) in the intermediate nut-holding plate (36). All of these three central through-openings are in register with each other and with the central access of the bollard tube assembly and the axis of extension of the actuator (14). The diameter of the central through-opening of the intermediate nut-holding plate is the smallest of the three.

Figure 21:
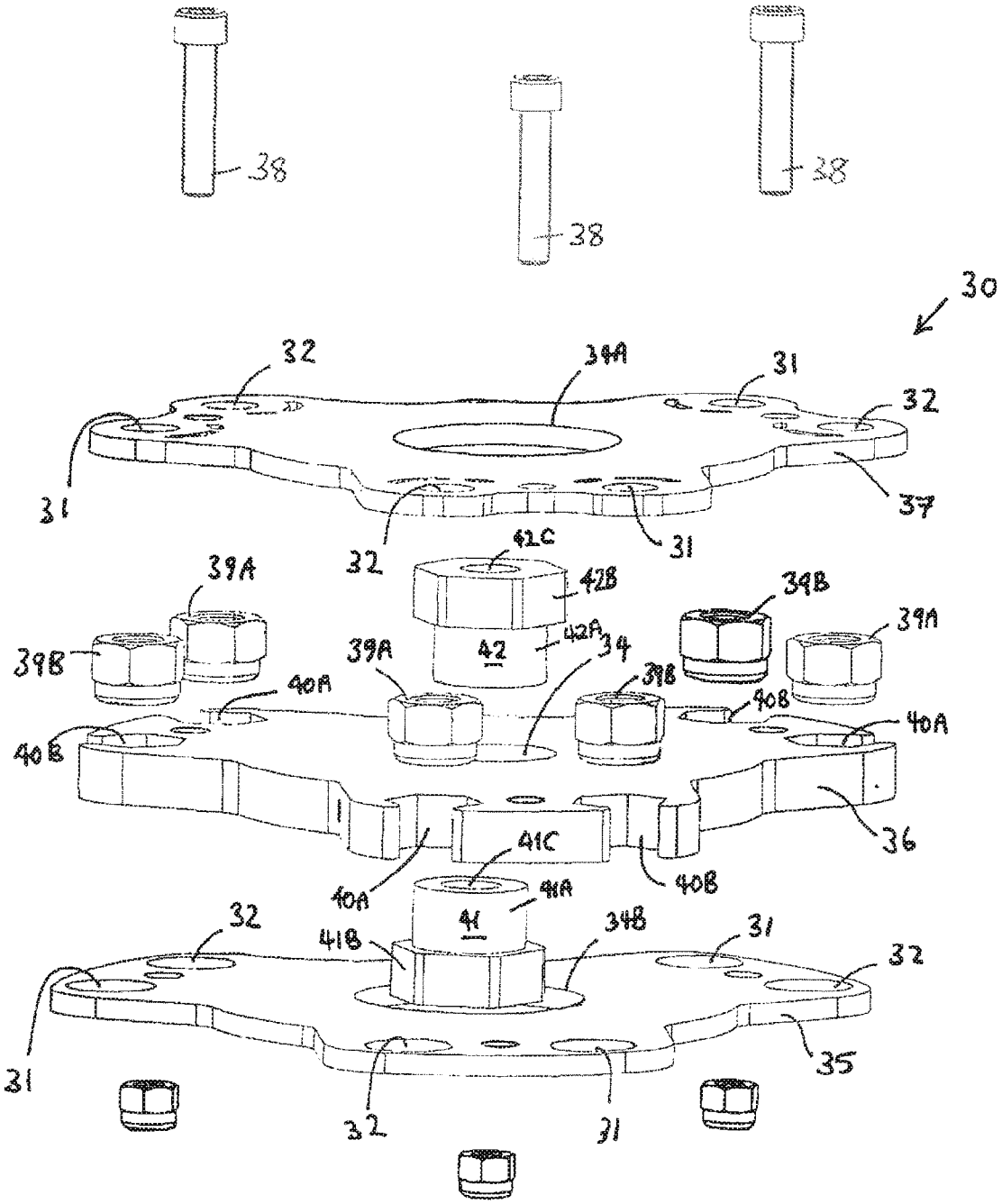
FIG. 21 illustrates an exploded view of the interface assembly of FIG. 20.

FIG. 21 illustrates the interface assembly (30) shown in FIG. 20 in an exploded form and includes two terminal coupling nuts (41, 42) which are fixed at the terminal end of the actuator in axial alignment and are arranged to moveably engage with the interface assembly as will now be described.

Figure 22:
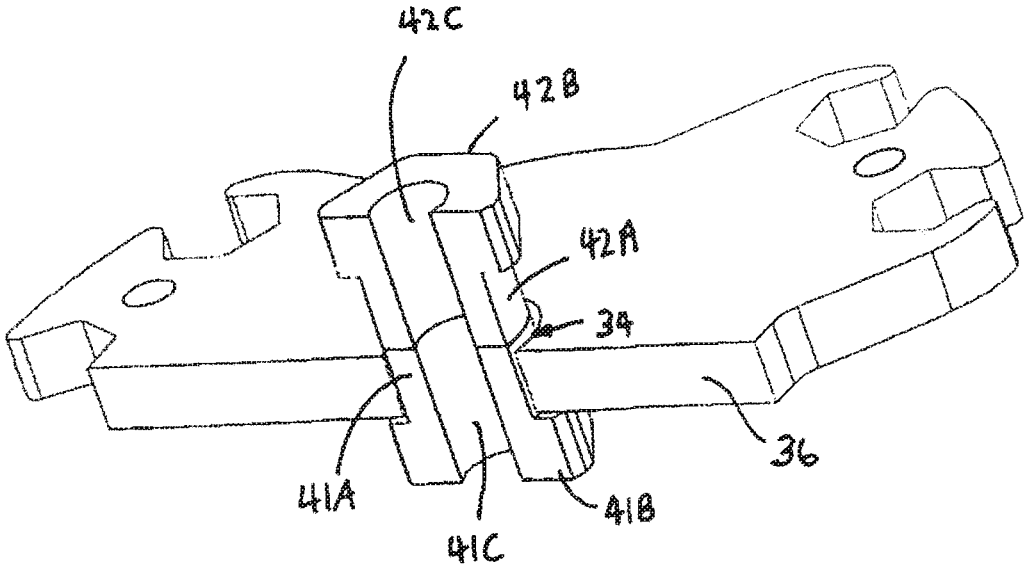
FIGS. 22 and 23 illustrate cross-sectional views of parts of the interface assembly of FIGS. 20 and 21.
Figure 23:
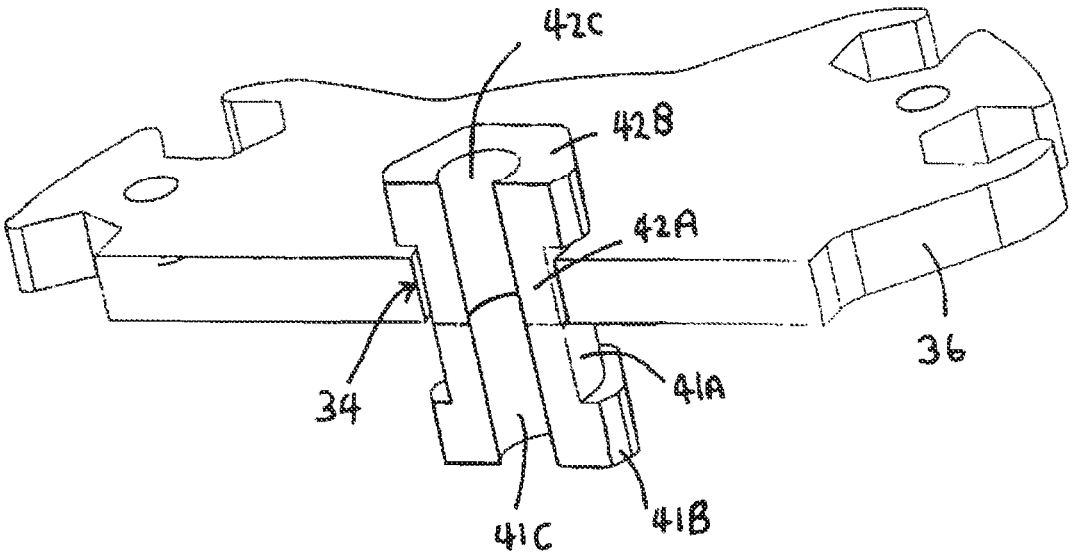

FIGS. 22 and 23 illustrate the terminal elements (41, 42) of the actuator and the intermediate nut-holding plate (36) of the interface assembly in a cross-sectional form.

The terminal end of the actuator (14—not shown in FIGS. 21 to 23) comprises an upper coupling nut (42) and a lower coupling nut (41) each of which is attached to the terminal end of the actuator by internal threading within the respective bores (41C, 42C) thereof. Each of the upper and lower coupling nuts comprises a narrowed section (42A, 41A) having an outer diameter which is less than the diameter of the through-opening (34) of the intermediate nut-bearing plate (36) of the interface assembly (30). Conversely, the remaining portions of each of the upper and lower coupling nuts (41B, 42B) each has an outer diameter which exceeds the diameter of the through-opening (34) of the intermediate nut-holding plate (36). The upper and lower coupling nuts are axially aligned in reverse orientation such that the narrower portion of the one is immediately axially adjacent to and abutting the narrower portion of the other. Consequently, the wider portion of the upper coupling nut is located above the upper surface of the intermediate nut-holding plate whereas the wider portion of the lower coupling nut is located below the lower surface of the intermediate nut-holding plate.

The two axially aligned and abutted upper and lower coupling nuts are able to freely move, by axial movement of the actuator (14) from a first position (shown at FIG. 22) in which the wider portion of the lower coupling nut abuts and urges against the underside of the intermediate nut-bearing plate (36), and a second position (shown in FIG. 23) in which the wider portion (42B) of the upper coupling nut rests above or against the upper surface of the intermediate nut-bearing plate (36) at those parts thereof adjacent to the central through-opening (34) of that plate. In the first position illustrated in FIG. 22, the actuator (14) may engage with the interface assembly to urge upwardly against the interface assembly to either push the bollard assembly upwardly, or to support the weight of the extended bollard assembly. The second position as illustrated in FIG. 23 may be achieved when the bollard assembly is fully retracted and the actuator (14) is also retracted. The coupling nuts bear no load in that state.

In the retracted state, when the terminal end of the actuator (14) is positioned relative to the interface assembly as is illustrated in FIG. 23, the top plate (11) of the bollard assembly may be removed to allow access to the stop flanges (27) of the top coupling ring (26) to enable the interface assembly (30) to be detached therefrom and removed from the bore of the inner bollard tube by unscrewing the upper coupling nut (42) from the terminal arm of the actuator (14) thereby to fully expose the bore of the bollard tube assembly allowing access to the rest of the actuator. This enables access for maintenance, cleaning etc.

It is to be noted that the laminar form of the interface assembly renders it easy to disassemble such that any one of the six hexagonal threaded nuts (39A, 39B) may easily be removed and replaced if the threading within one of them comes damaged. As a result, damaged threading within the interface assembly merely requires replacement of a damaged nut, and does not require replacement of the entire interface assembly or the complex and expensive process of re-tapping of a damaged thread within it.

Figure 24A:
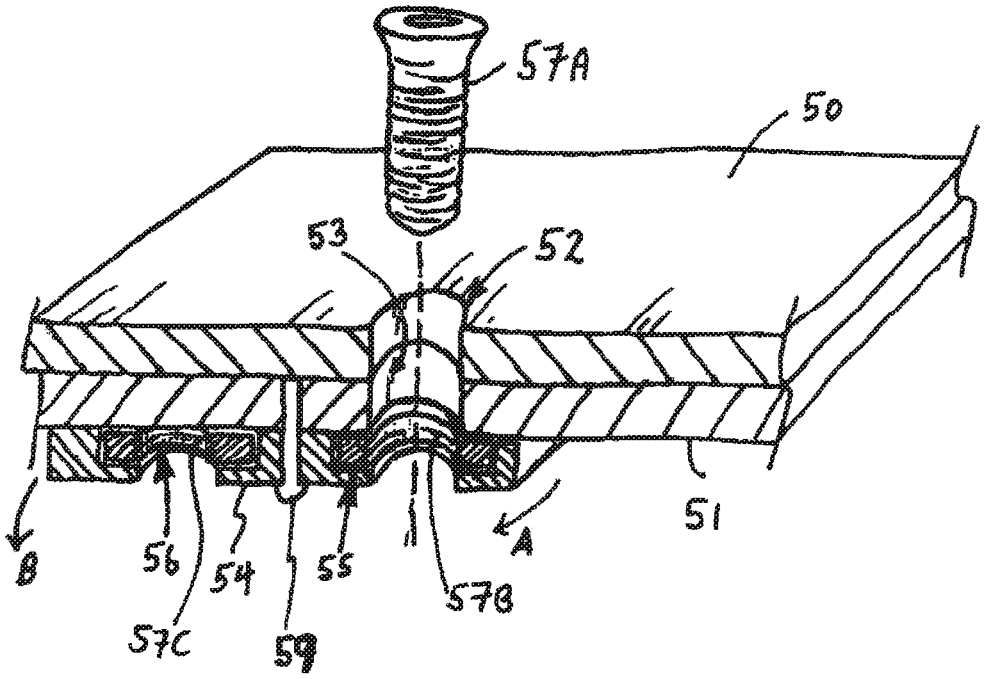
FIGS. 24A and 24B show two respective views of a connector nut holder for use in the bollard assembly, or components thereof, of any of FIGS. 1 to 23.
Figure 24B:
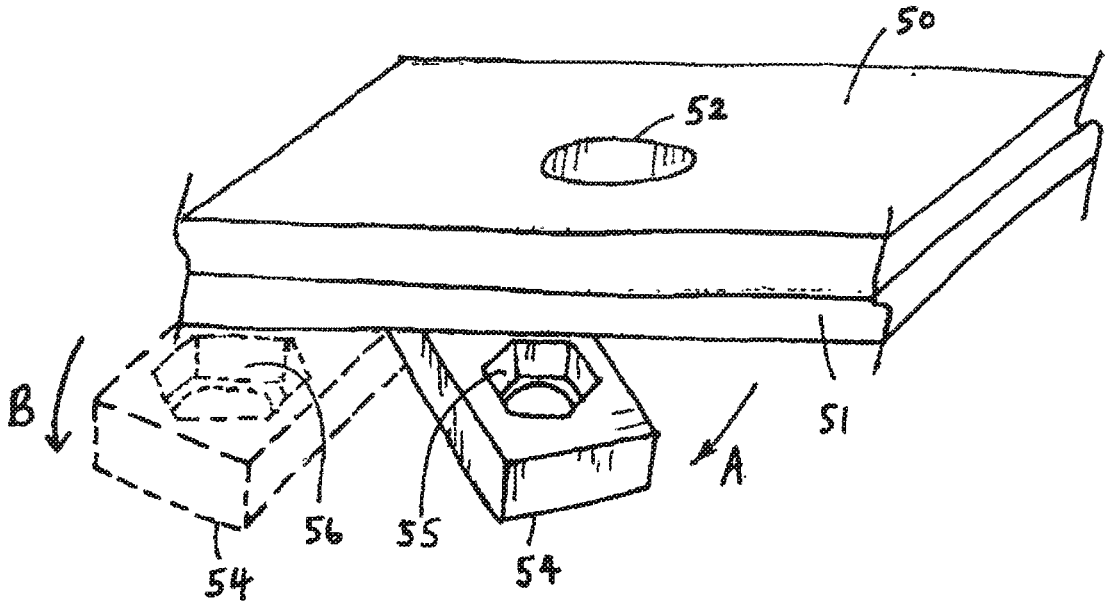

FIGS. 24A and 24B show schematic views (in cross section and in perspective respectively) of two mutually connected assembly parts of a bollard assembly. A first assembly part (50) includes a first aperture (52) defining a through-opening. A second assembly part (51) has a second aperture (53) defining a through-opening. A first threaded connector bolt (57A) is adapted to extend through the first aperture and the second aperture concurrently to engage with a reciprocally threaded nut (57B) collectively to sandwich therebetween portions of the first and second assembly parts. A seat part (54) is shaped reciprocally to hold the nut (57B) via an aperture (55) having side walls which reciprocally correspond to the external (hexagonal) nut shape to prevent rotation thereof when seated. The seat part is mounted to the first assembly part via a pivot pin (59) to be slidingly (rotatingly) moveable adjacent thereto (direction A) between a first position (shown in FIG. 24A) which places the seat part in register with the first and second apertures (52, 53), and a second position (shown in FIG. 24B) which exposes the seat part permitting removal and replacement of the nut (57B) when seated therein.

The arrangement illustrated in FIGS. 24A and 24B includes a second seat part (56) attached to the first seat part and shaped to hold a spare nut (57C). The second seat part is slidingly moveable (direction B) between a position in which it is concealed by the first assembly part and the second assembly part, and a position which exposes the second seat part permitting retrieval of the spare second connector when seated there.

FIGS. 25 to 28 show stages of an alternative embodiment involving the sliding linear movement of a seat part.

Figure 25:
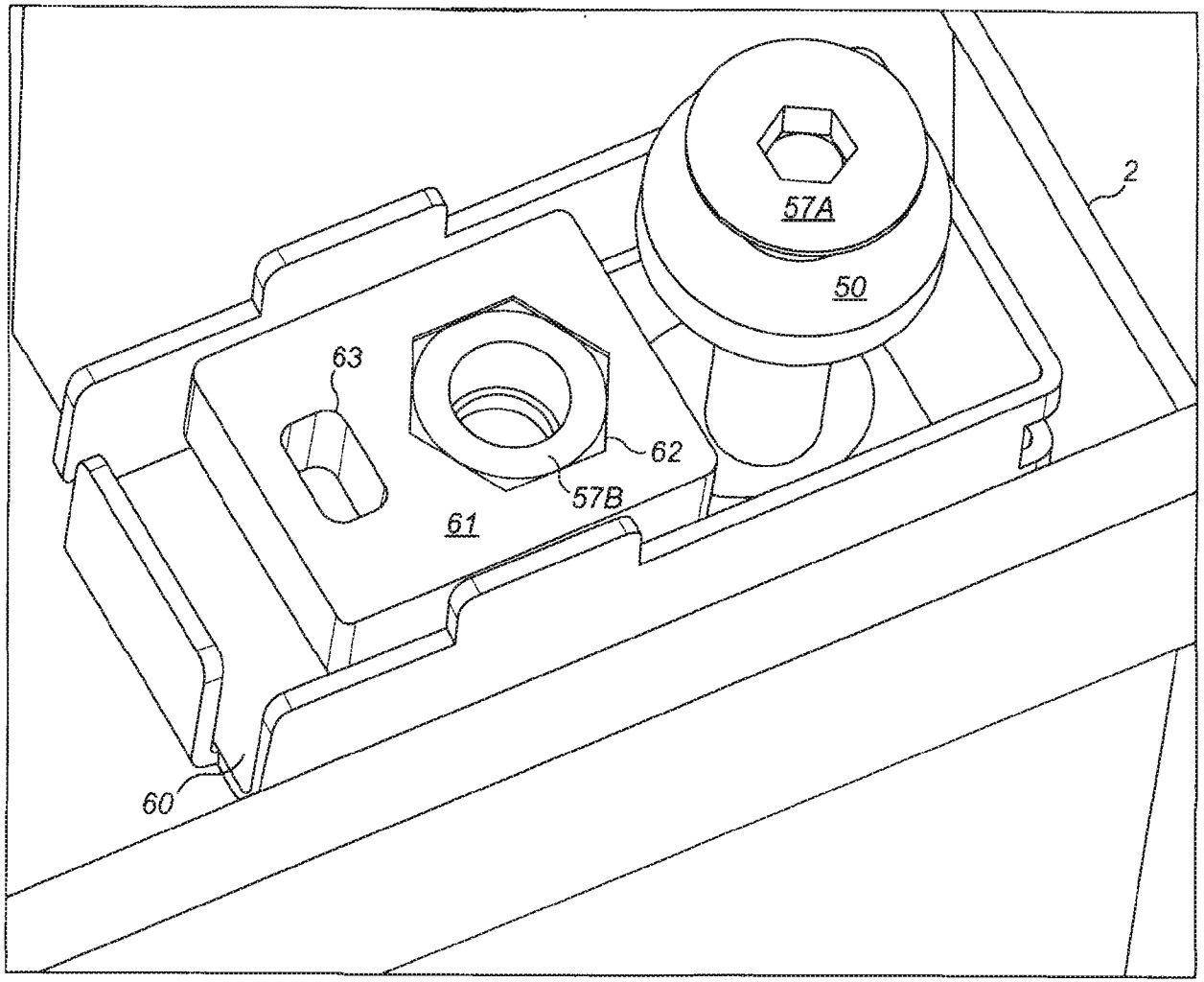
FIGS. 25, 26, 27 and 28 show views of a connector nut holder of the housing of the bollard assembly of FIGS. 1 to 15.
Figure 26:
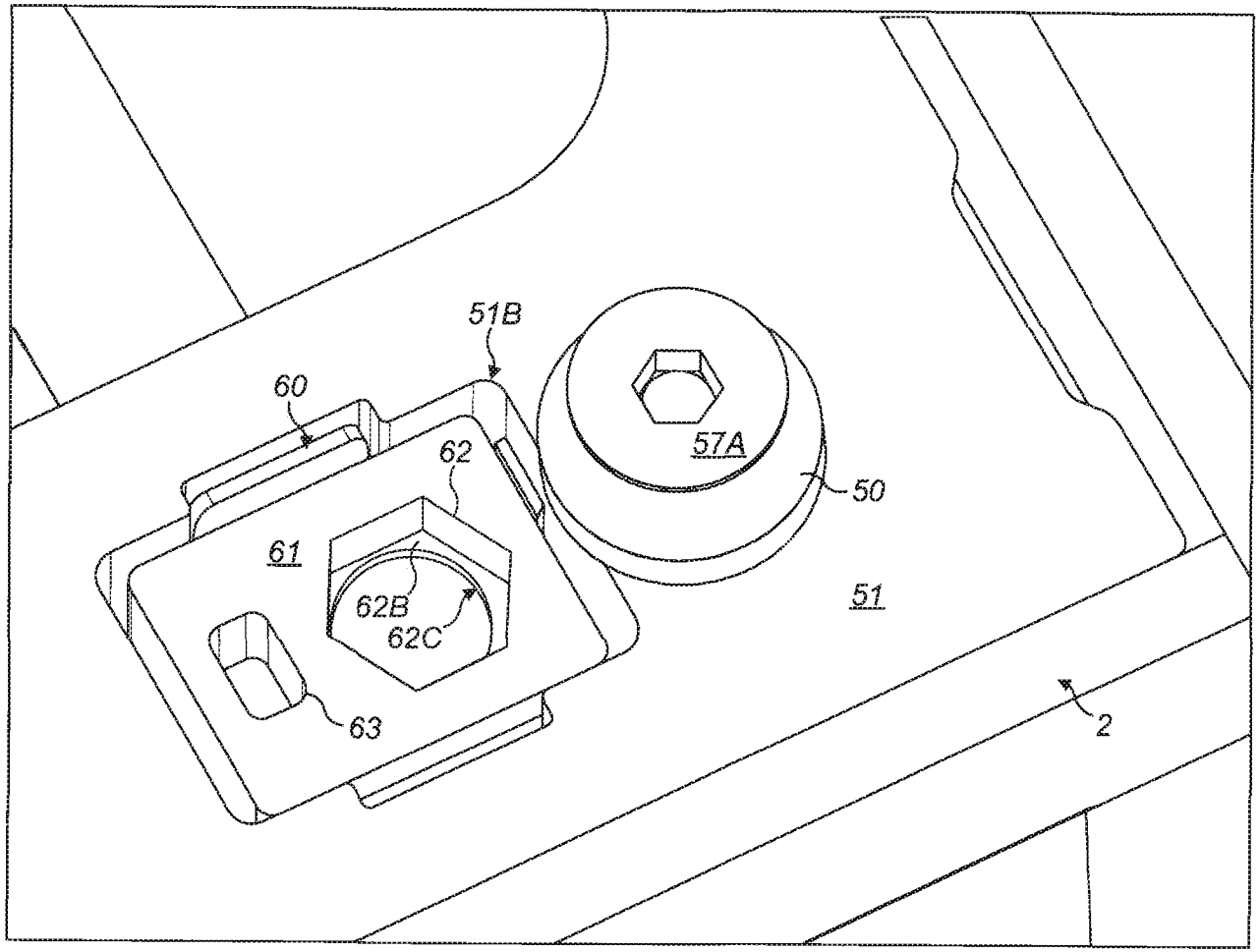
Figure 27:
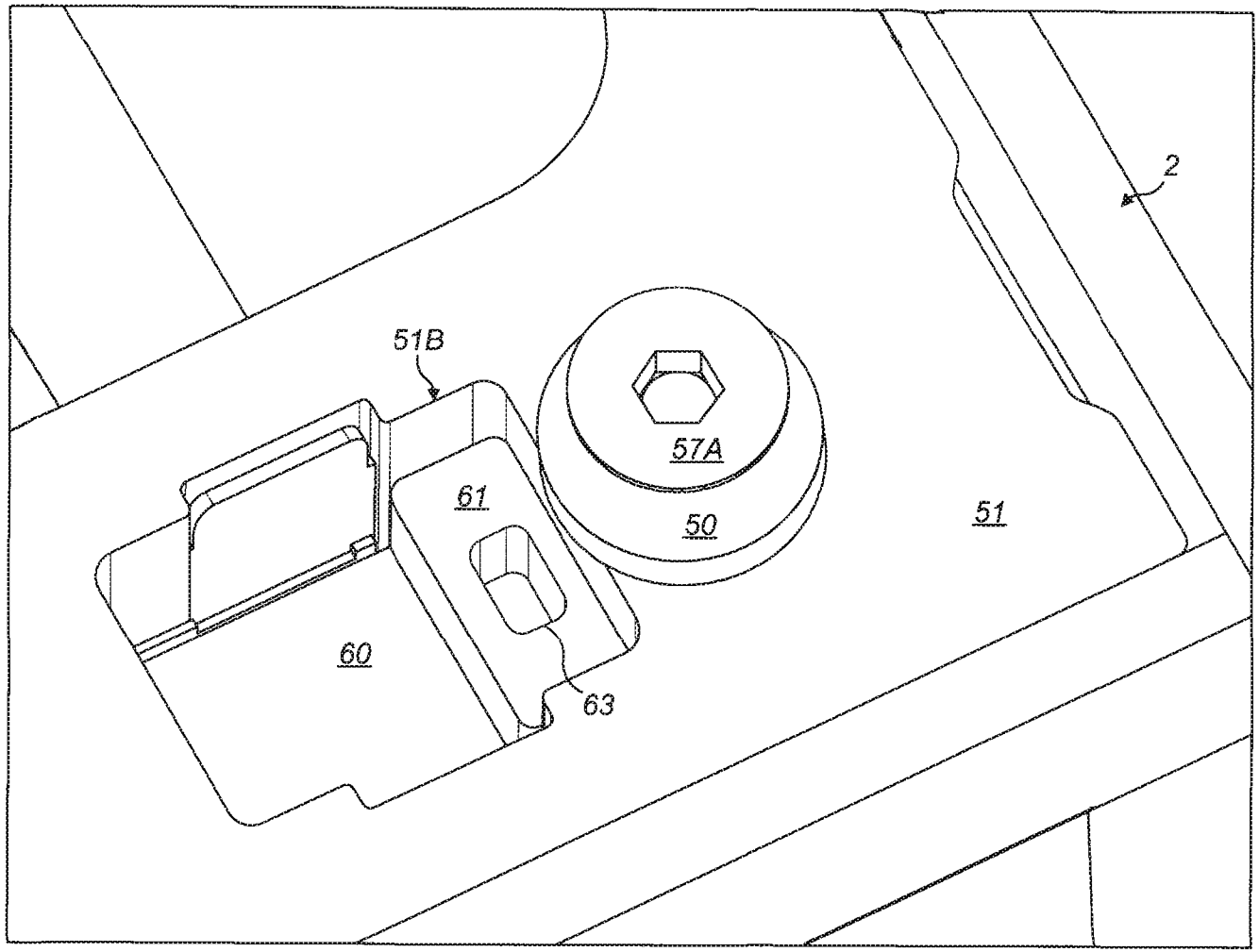

A first assembly part (50) in this example comprises the top plate of the housing (2) of which only a small circular portion (50) is shown around the bolt (57A) in the cut-away views of FIGS. 25 to 27 to aid clarity. The top plate includes a first aperture (52—not shown: occupied by the bolt) defining a through-opening. A second assembly part (51) comprises an internal beam within the housing (2) which has a second aperture (53—not shown: occupied by the bolt) defining a through-opening. The threaded connector bolt (57A) is adapted to extend through the first aperture and the second aperture concurrently to engage with a reciprocally threaded nut (57B) collectively to sandwich therebetween portions of the first and second assembly parts (50, 51). A seat part (61) is shaped reciprocally to hold the nut (57B) via a seating aperture (62) having side walls which reciprocally correspond to the external (hexagonal) nut shape to prevent rotation thereof when seated.

The seat part is mounted to the first assembly part via basket part (60) to be slidingly (linearly) moveable therealong between a first position (shown in FIG. 27) which places the nut in register with the first and second apertures (52, 53), and a second position (shown in FIG. 26) which exposes the seat part permitting removal and replacement of the nut (57B) when seated therein.

Figure 28:
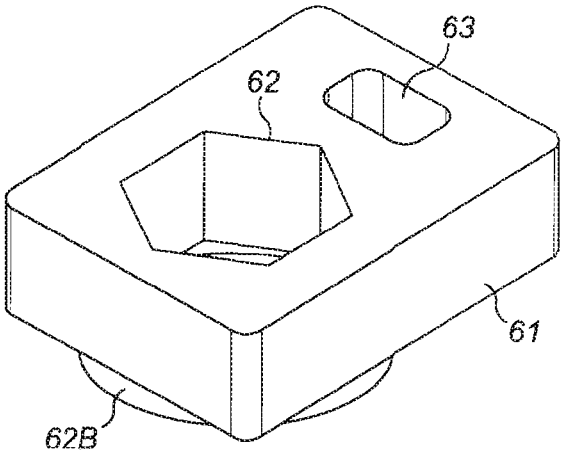

Here, the basket part (60) defines a linear channel or conduit along which the seat part (61) is restrained to slide between the first position (FIG. 26) in which the seated nut (57B) is exposed permitting removal (FIG. 26) and not in register with the bolt (57A), via an intermediate position (FIG. 25) along the conduit to the second position (FIG. 27) in which it is in register and engages with the bolt. FIGS. 26 and 28 show the seat part (61) in detail. The seating aperture (62) defines at its base a seat base (62B) comprising the rim of a circular aperture in register with the hexagonal aperture for receiving lock nut (57B) and having a diameter less than that of the hexagonal aperture such that the rim is exposed through the hexagonal aperture to support a lock nut upon it. The circular aperture permits the shaft of the bolt (57A) to pass therethrough if desired.

The first assembly part (51) includes a third aperture (51B) which is spaced from the first aperture (not shown) through which the bolt (57A) passes, and which defines a through-opening in register with which the seat part is positionable by the linear sliding of the seat part to render the seat part accessible therethrough. This permits the removal and replacement of the nut therethrough, and of the entire seat part as shown in FIG. 26. The third aperture is rectangular and is dimensioned to admit the rectangular seat part through it unobstructed. The basket part is fixed to the first assembly part (51) by an interference fit between the sides of the basket part and the walls of the third aperture. A rectangular end slot (63) is adapted to receive the end of a screwdriver or the like to allow that end to push the seat part to and fro along the linear channel (60) to bring the seat part, and the hexagonal nut within it into and out of register with the bolt (57A) as desired. The same may be used to lift the seat part out through the third aperture. The seat part is dismountable from the first assembly part (51) through the third aperture (51B) when in register therewith.

Figure 29:
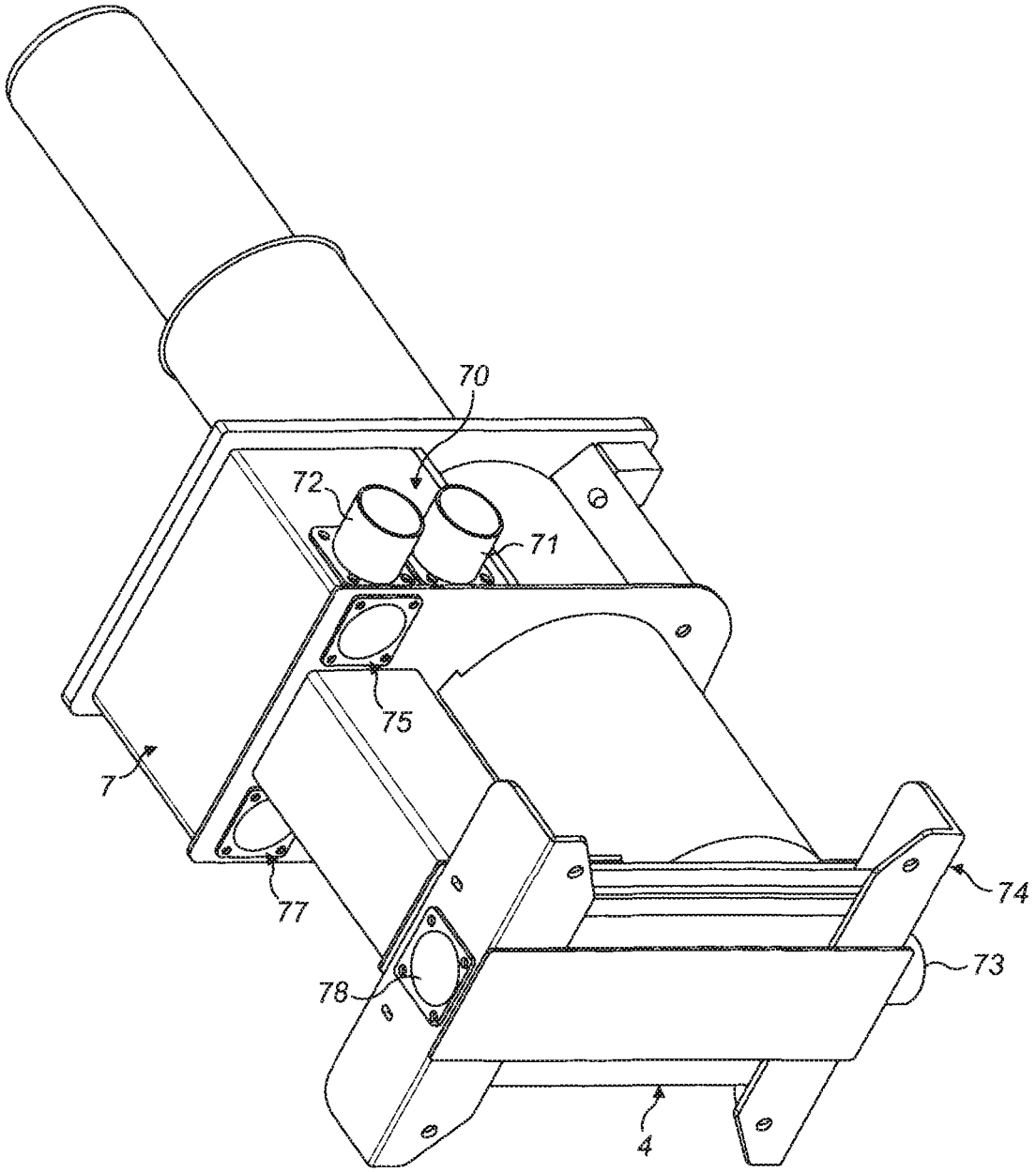
FIGS. 29, 30 and 31 show perspective views of elements of the housing of the bollard assembly of FIGS. 1 to 15 exposing duct openings within the housing.
Figure 30:
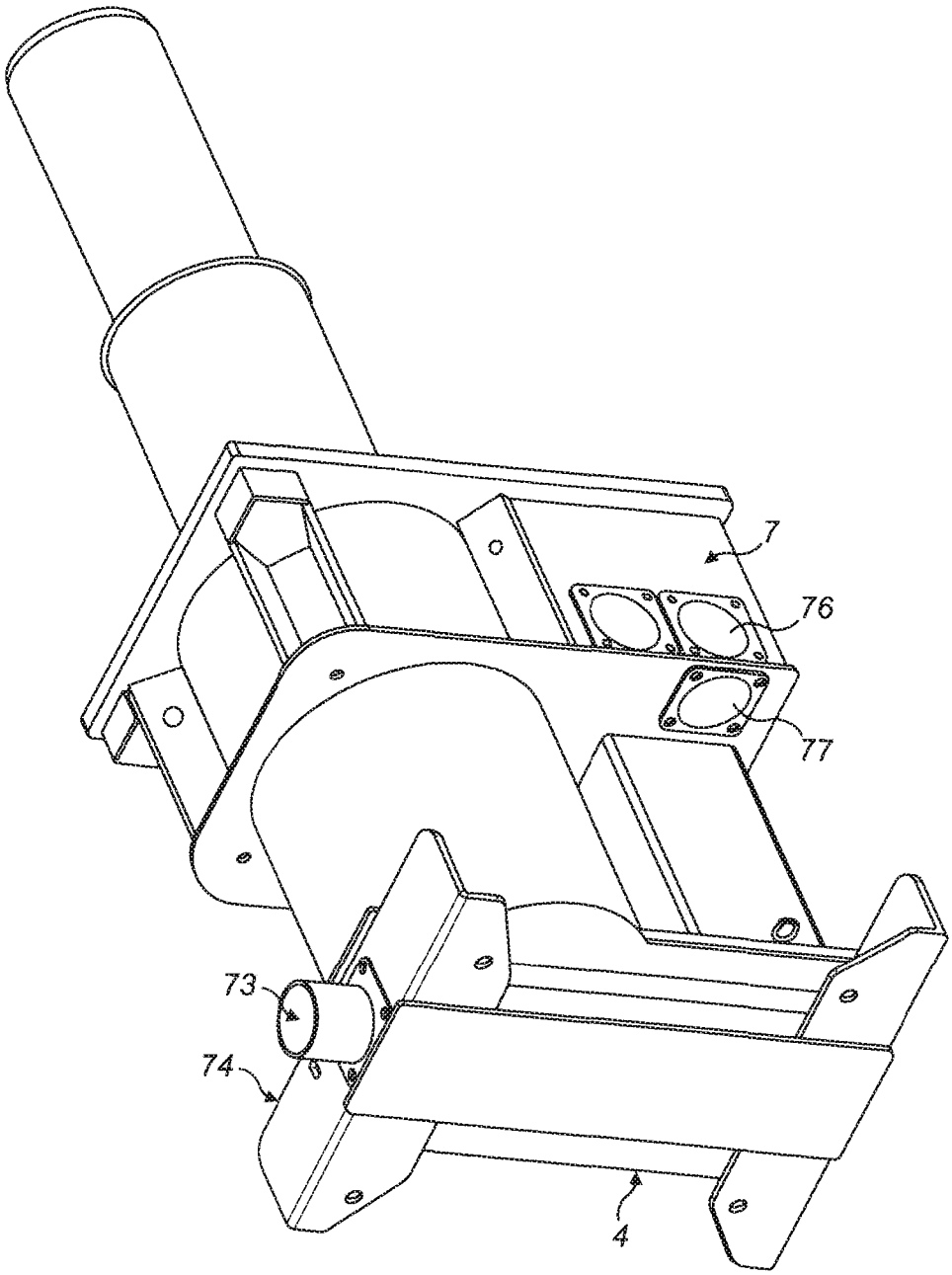
Figure 31:
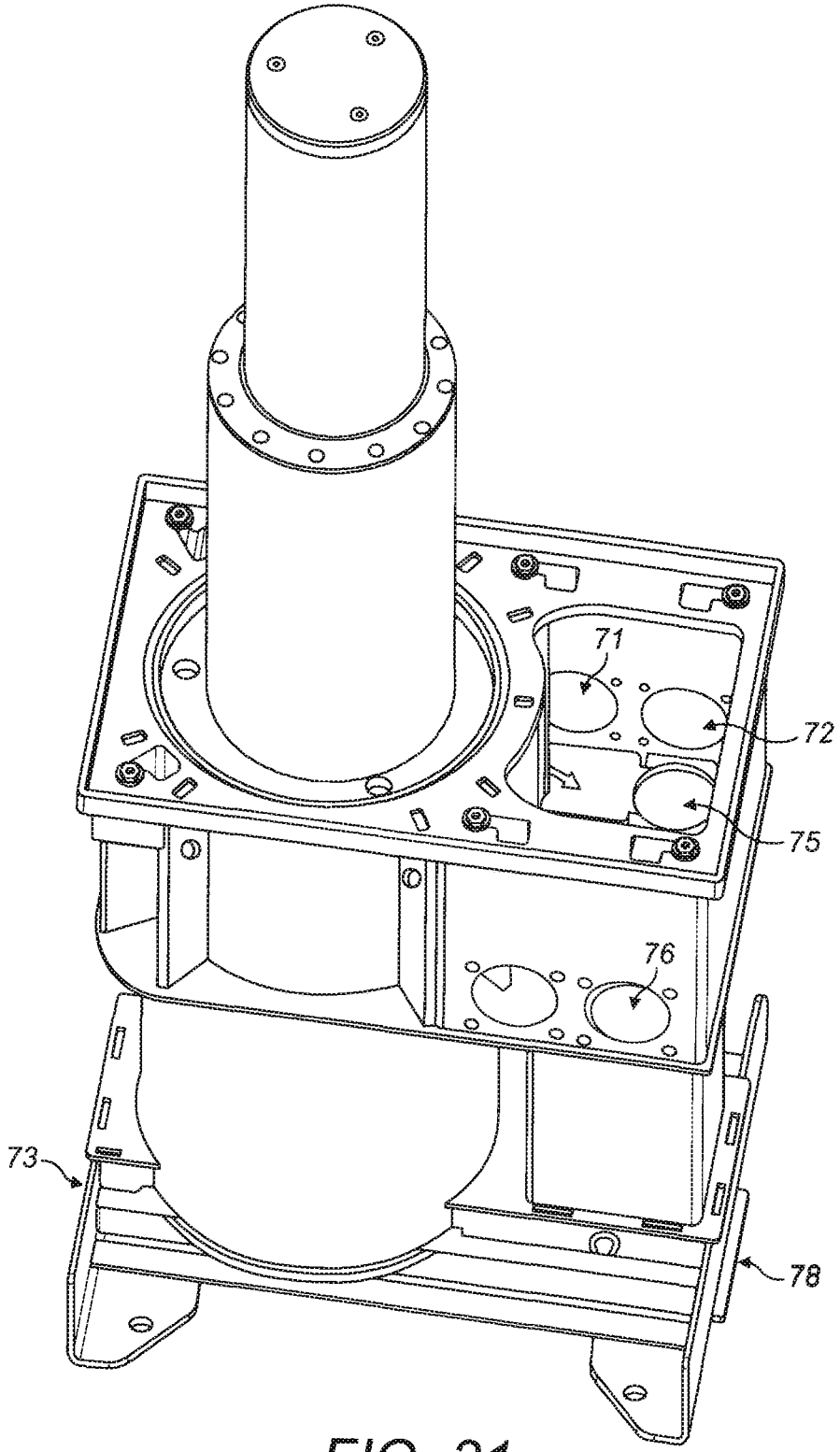
Figure 34:
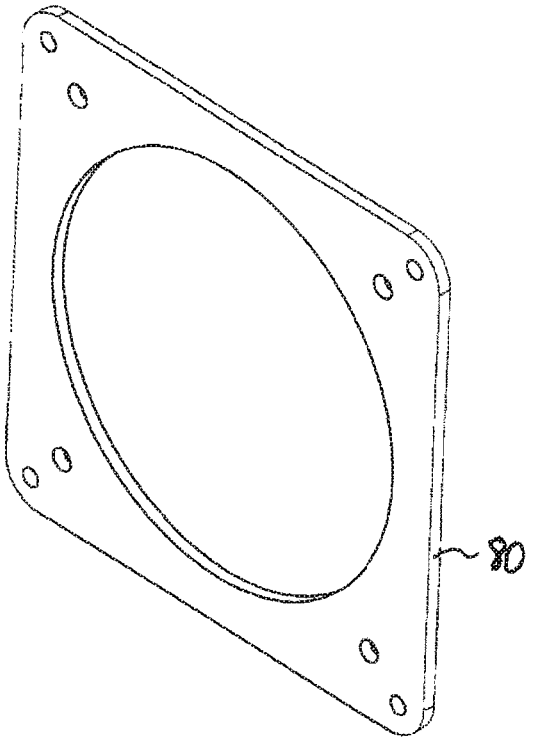

FIGS. 29 to 31 show the housing and bollard tubes extended. A power assembly (not shown) is housed within a compartment (7) of the housing part and serves the actuator to power it to urge the bollard part to move relative to the housing part between a retracted state. A side wall (74) of the housing part includes an aperture (73) defining a first housing outlet adjacent the base (4) of the housing part. A base of the compartment (10) spaced from the base (4) of the housing part includes an aperture (75) defining a second housing outlet facing in a direction towards the base of the housing part. The second housing outlet is concealed by a removable cover plate (FIGS. 29 and 30), the cover plate being removed in FIG. 31 to reveal the outlet.

A side wall (70) of the compartment (7) includes an aperture defining a third housing outlet (72) adjacent the second housing outlet. The third housing outlet faces in a direction generally transverse to the direction in which the first housing outlet faces.

The housing includes an aperture (76) defining a fourth housing outlet in a side wall of the compartment opposite to that containing the third housing outlet (72) and substantially in register therewith. The base of the compartment includes an aperture defining a fifth housing outlet (77) located adjacent the fourth housing outlet (76) and facing in a direction towards the base (4) of the housing part and generally transverse to the direction in which the fourth housing outlet faces.

An aperture defining a sixth housing outlet (78) is located adjacent the base of the housing part in a side wall of the housing part opposite to that containing the first housing outlet (73) and positioned substantially in register with the first outlet opening.

Figure 32:
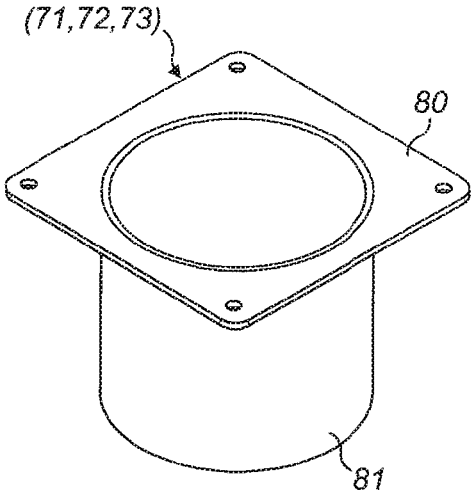
FIGS. 32, 33, 34 and 35 illustrate elements of a duct structure or a duct cover (FIG. 35) associated with duct openings of the housing illustrated in FIGS. 29 to 31.
Figure 33:
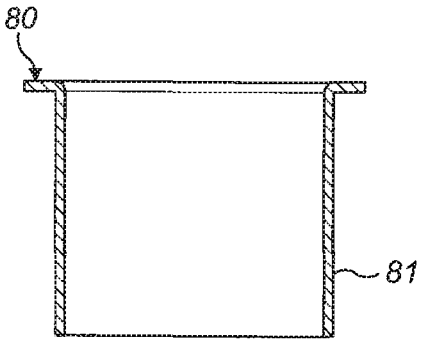

Detachable cover plates are attached to the housing part at the second, fourth, fifth and sixth housing outlet apertures to close the housing outlet thereto. Detachable duct members each comprising a duct (81, FIGS. 32 and 33) terminating at a flange (80, FIGS. 32, 33, 43) attached to the housing part at an aperture to place the duct in register with the aperture to define an outlet duct at the first and third housing outlets.

Figure 35:
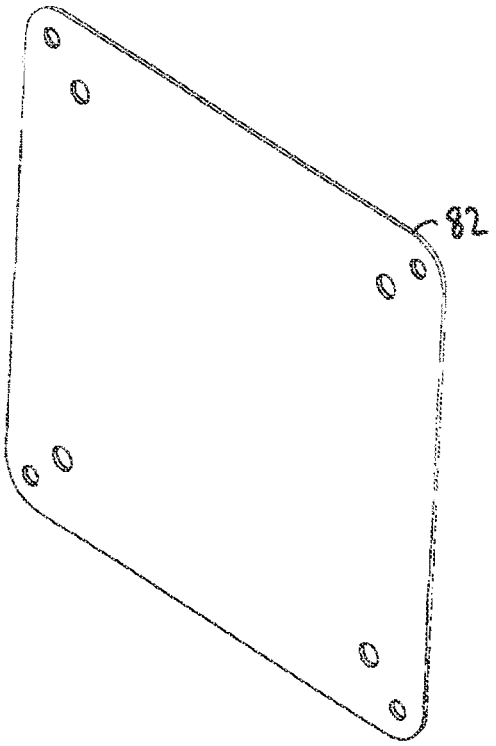

Each cover plate (82, FIG. 35) and duct flange (80) possesses bolt holes passing through it to accept bolts with which to be fixed (detachably) to a wall of the housing of the bollard assembly in register with an outlet aperture thereof, either to conceal the aperture (cover plate) or to surround it (duct). FIG. 31 shows the bollard assembly with all cover plates and ducts detached, as well as with the top plate of the housing removed for clarity of view. Any one or more of the outlet apertures may be selected for concealment with a cover plate, and the others selected for use with ducts as outlet apertures. Drainage piping, power or communications cabling and lines may be passed into and out of the housing of the bollard assembly via the uncovered outlet apertures in any one of three mutually perpendicular directions. This permits great versatility in directing such cabling and lines in a way which avoids underground obstacles and enables successive bollard housings to be connected via such lines when in other than simple linear arrays.

The bollard assembly may comprise a guide bore such as described above, and a tubular bollard (e.g. the inner or outer bollard tube) mounted within the guide bore to extend therealong from a base end of the bollard tube so as to be slidingly moveable along the guide bore between a retracted state and an extended state such as described above. The assembly, in a preferred embodiment, includes a plurality of bearing assemblies comprising several bearing blocks (90) and associated hexagonal nuts (94) attached to the bollard tube (5) between an outer tubular surface of the bollard tube and an opposing inner surface of the guide bore of the casing tube (8) thereby to form a sliding interface therebetween. The bearing blocks are moveable relative to the bollard part to adjustably vary the separation between the sliding interface and the bollard tube.

The bearing blocks (90) each present a plurality separate interface surface parts (93A to 93F) each adapted for selectably providing a sliding interface and each being spaced by a different respective amount from an axle axis (92) of the bearing block about which the bearing block is rotatably mounted to the bollard tube thereby being separately positionable by action of rotation about the axle axis (and an axle there) to adjustably vary the separation between the sliding interface and the bollard part.

The axle axis is substantially parallel to the longitudinal axis of the column of the bearing blocks, bollard tube and the axis of the guide bore.

The interface surface areas (93A to 93F) of the bearing blocks form surface parts of a hexagonal column defining the bearing block attached to the bollard part via said axle.

The interface surface areas each present a convex curvature having a radius of curvature which substantially matches the radius of curvature of the inner surface of the guide bore (8) and which coincides therewith when the interface surface area is positioned to form the sliding interface.

The bearing block may present any substantially polyhedral shape defined by contiguous interface surface parts. In the present example, the shape is a right-hexagonal cylinder/column shape. The bearing blocks (90) are shaped as a solid hexagonal column which presents six consecutive side surfaces (93A to 93F) of equal shape and area and each presenting a slight convex curvature having a radious of curvature substantially matching (and coincident with, in use) the radius of curvature of the opposing inner surface of the guide bore (8) with which they are each adapted to be used to form a sliding interface.

Each bearing block is attached to the bollard tube (e.g. the outer bollard tube (5)) via a mounting assembly (17, 18) fixed to the bollard tube and including a regular polygonal aperture (102) having the same number of sides as there are separate interface surface and adapted to intimately receive a correspondingly polygonal end (94) of a lock nut (94) of the bearing assembly in any one of a plurality of orientations each of which aligns the polygonal end (lock nut) with the polygonal aperture to allow the polygonal end to be received therein. Each orientation positions a selectably different one of the separate interface surface parts as said sliding interface.

Figure 38:
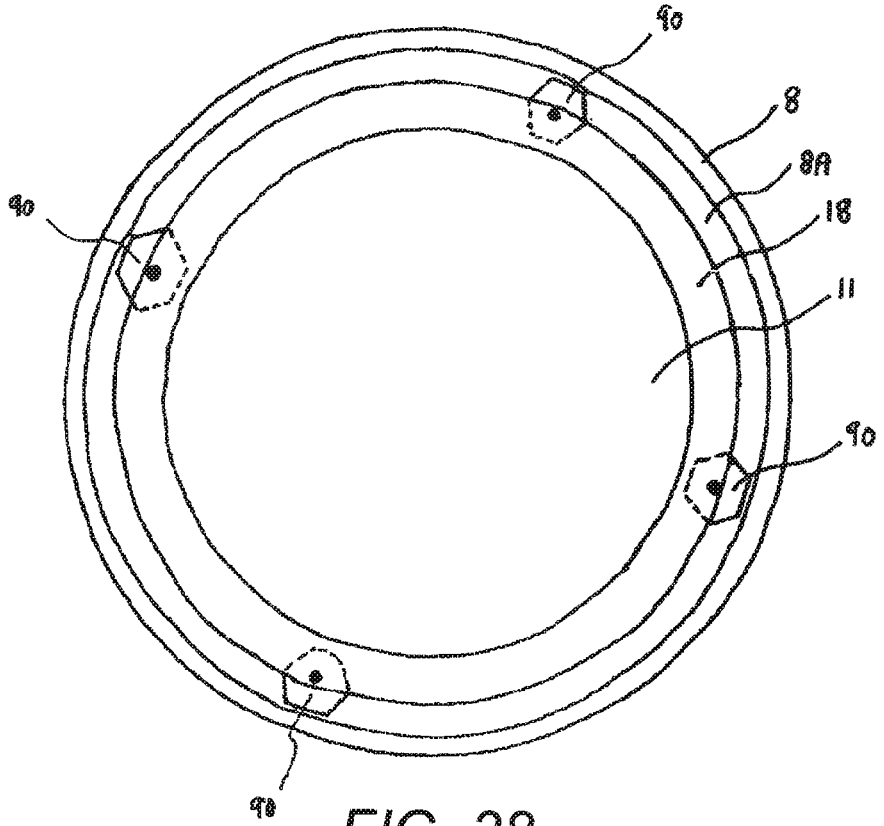

The bollard assembly comprises four such bearing assemblies arrayed circumferentially around the bollard part as shown in the top view of FIG. 38.

Figure 36:
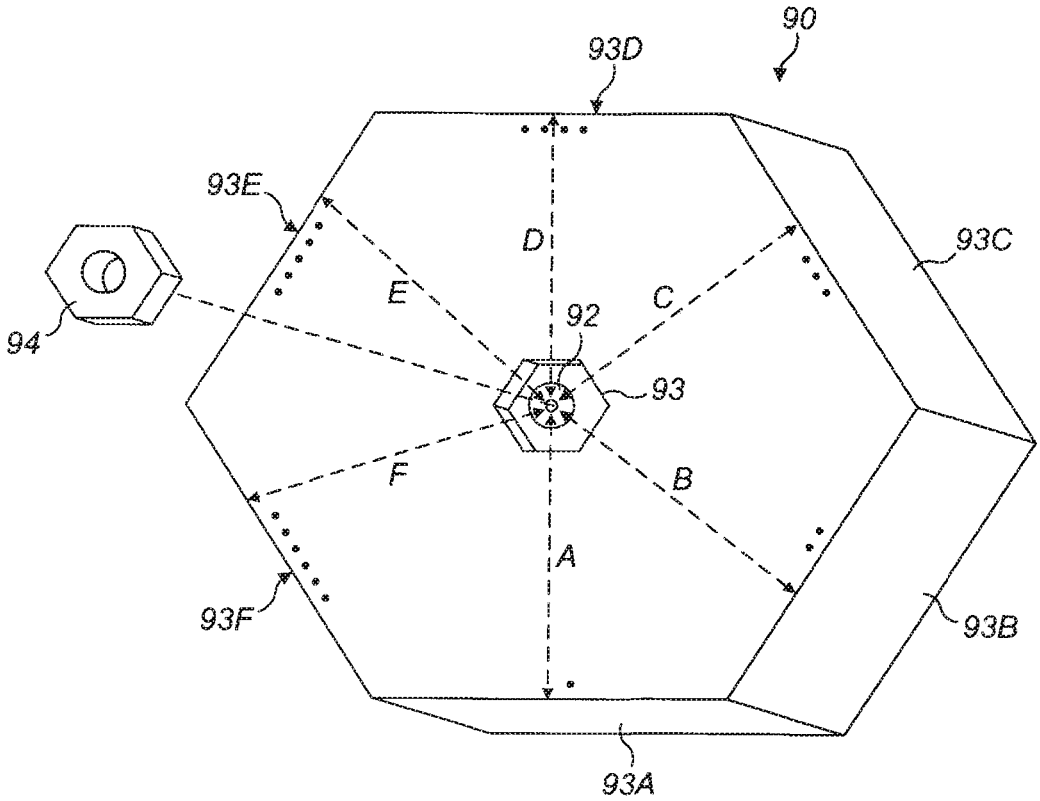
FIGS. 36 to 39 illustrate views of an adjustable bearing assembly for use in the telescopic bollard assembly illustrated in FIGS. 1 to 15.

The hexagonal bearing block (90) illustrated in FIG. 36 comprises six very slightly convexly curved bearing surfaces (93A to 93F) each one of which is generally outwardly presented in a direction perpendicular to the axis (92) of the bearing block column. Each of the six bearing surfaces is spaced from the axis by a distance (A, B, C, D, E or F) which differs slightly (by 0.5 mm or thereabouts, for example) from any of the corresponding such distances associated with any one of the other of the six bearing surfaces.

In particular, a first bearing surface (93A) is spaced from the axis of the bearing block by a first distance A. The separation B between the second bearing surface—(93B) adjacent to and contiguous with the first bearing surface—and the block axis is a distance B which is greater than the distance A. A third bearing surface (93C) adjacent to and contiguous with the second bearing surface is spaced from the block axis by a distance C which exceeds the distance B. A fourth bearing surface (93D) adjacent to and contiguous with the third bearing surface is spaced from the block axis by a distance D which exceeds the distance C. A fifth bearing surface (93E) is adjacent to and contiguous with the fourth bearing surface and is spaced from the block axis by a distance E which exceeds the distance D. A sixth bearing surface (93F) is adjacent to and contiguous with the fifth bearing surface and is spaced from the block axis (92) by a distance F which exceeds the distance E. The sixth bearing surface is also adjacent to and contiguous with the first bearing surface. As a result, if the difference in distances is constant (e.g. B−A=C−B=D−C=E−D=F−E=constant, such as 0.5 mm) then the maximum range of adjustment of the position if the sliding interface relative to the axis of the outer bollard tube is E-A (e.g. 2.5 mm).

Figure 37:
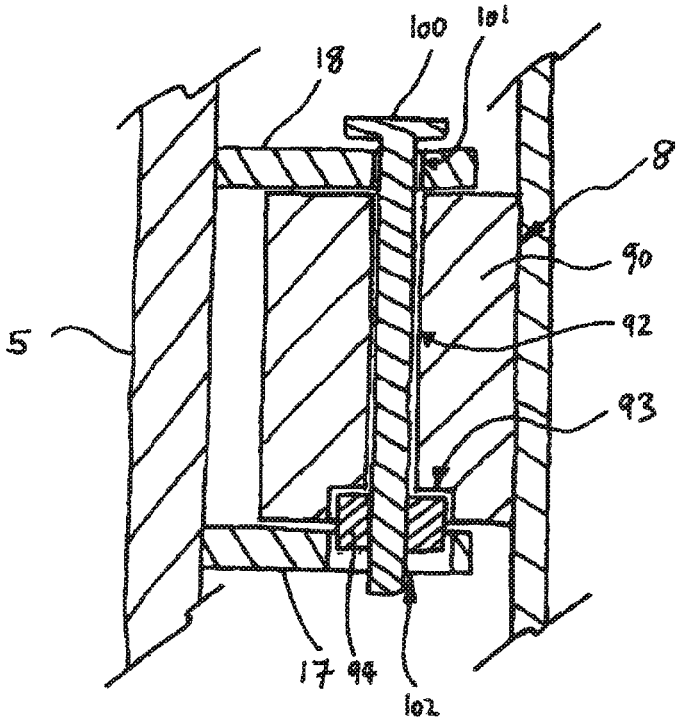

A hexagonal lock nut (94) forms part of the bearing assembly and is adapted to be received within a lock nut seating recess (93) formed in the centre of a flat end surface of the bearing block to place the through-opening of the lock nut in register with a through-bore (92) defining the axis of the bearing block. It will be noted that the hexagonal side walls of the seating recess (93) are adapted to intimately and closely correspond with the hexagonal outer shaping of the lock nut (94) such that the lock nut is axially removable from the seating recess but cannot be rotated within the seating recess once seated. It is also noted that each one of the side walls of the hexagonal seating recess are parallel and aligned with a respective one of the six bearing surfaces (93A to 93F) of the bearing block. FIG. 37 illustrates a cross-sectional schematic view of a part of the bollard assembly comprising the outer bore tube (5) and the opposing parts of the bore of the casing tube (8) containing the outer bollard tube.

The upper (18) and lower (17) collar rings of the outer bollard tube each possess a through-opening (101, 102) aligned in register mutually with each other. The through-opening in the lower collar ring (102) is hexagonally shaped and adapted to align to the hexagonal shape of the hexagonal seating recess (93) of the coupling block (90) such that, once so aligned, a selected one of the six bearing surfaces (93A to 93F) is positioned in parallel to and direct opposition to the opposing inner surface of the guide bore of the casing tube (8) of the bollard assembly. The depth of the hexagonal seating recess is less than the height of the hexagonal lock nut (94) it is adapted to receive. The result is, as shown in FIG. 37, that when the hexagonal lock nut is seated within the hexagonal seating recess it projects outwardly of the recess to some extent. The projecting parts of the seated hexagonal lock nut may then be snugly received within the hexagonal through-opening in the lower collar ring (102) such that the through-opening prevents rotation of the hexagonal lock nut within it and thereby prevents any rotation of the hexagonal block within which the hexagonal lock nut is seated.

The axial length of the column of the hexagonal bearing block (90) substantially matches (and is preferably very slightly less than) the separation between the opposing surfaces of the lower collar ring (17) and the upper collar ring (18) such that the hexagonal bearing block may be slidingly placed within that separation without being tightly fitted within it.

An axle bolt (100) passes down through the through-opening (101) in the upper collar ring (18), passes fully through the entire length of the bore of the axis (92) of the hexagonal bearing block, subsequently through the hexagonal lock nut (93) with which it engages via mutually adapted threading, and passes through the hexagonal through-opening in the lower collar ring (102).

The bearing surface (93A to 93F) with which a user wishes to form an interface with the opposing inner bore surface of the casing tube (8) maybe selected (preferably initially before inserting the outer bollard tube into the bore of the outer bollard case (8), by turning the axle bolt (100) in such a direction as to cause it to disengage from the hexagonal lock nut seated within the hexagonal seating recess (92) of the bearing block and the hexagonal through-opening (102) of the lower collar ring. Once the hexagonal lock nut has disengaged from the axle bolt, the hexagonal bearing block may be rotated about the axle bolt to present an alternative one of the six bearing surfaces outwardly as desired. This may be achieved by turning the axle bolt sufficiently to force the lock nut (94) axially along the axle bolt until it is pushed out of the hexagonal seating recess (92) without fully disengaging from the axel bolt. This un-seating permits the bearing block to be rotated as desired. A reverse rotation of the axle bolt then re-seats the lock nut in the hexagonal seating recess thereby to restrain the hexagonal bearing block in the new position. Referring to FIG. 6, the terminal end of the hexagonal bearing block possesses adjacent a respective one of the six interface surfaces a sequence of 1, 2, 3, 4, 5 or 6 dots marked upon the block which serve as a visual aid to identifying which of the six alternative interface surfaces a user has selected. These dots may be formed on both of the opposite end surfaces of the hexagonal bearing block.

In this way, by selecting an appropriate bearing surface, a user may thereby select a desired separation between the axis bolt (100) and the inner surface of the guide bore (8) against which a selected interface surface is slidingly abutted in use. This is, of course, because selection of one of the six interface surfaces also corresponds to a selection of one of the six different perpendicular distances (A to F) which separate the interface surfaces for the access of the bearing block through which the axel bolt (100) passes. The axial position of the outer bollard tube may thereby be carefully and adjustably selected and perfected by the appropriate selection of sliding interface surfaces in each one of a plurality of interface blocks (90) arranged regularly and circumferentially around the outer bollard tube as illustrated in FIG. 38.

The regular circumferential array illustrated in FIG. 38 shows a sequence of four interface assemblies (90) each mounted to (and between) upper and lower collar rings (17, 18) via through-openings (101, 102) which are themselves all the same distance from the central axis of the outer bollard tube. In further preferred embodiments, additional through-openings (101, 102) maybe formed in the upper and lower collar rings at different radial positions from the central axis of the outer bollard tube to enable variation in the radial positioning of the interface assembly (90) by relocating it from one pair of through-openings (101, 102) to a different pair of through-openings positioned at a different radial separation from the central axis of the outer bollard tube.

Figure 39:
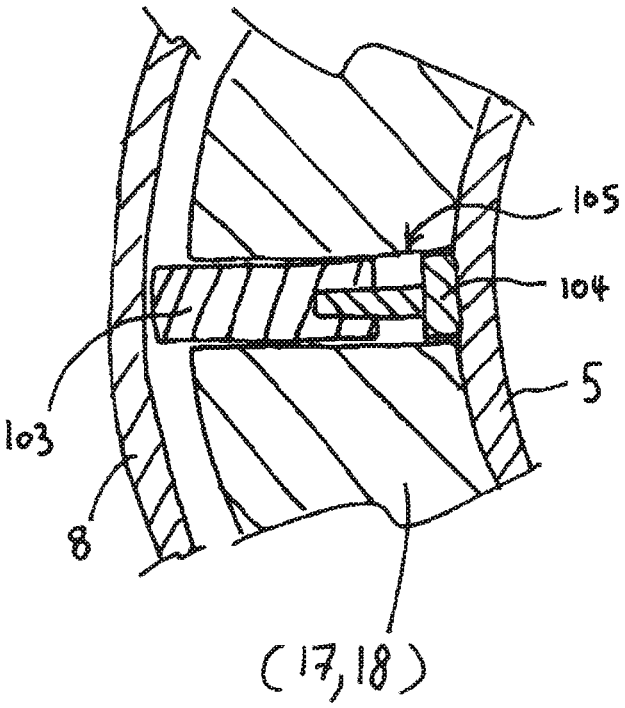

FIG. 39 schematically illustrates an alternative embodiment for an interface assembly comprising a radial through-bore (105) passing radially through an upper and/or lower collar ring (17, 18). The interface assembly comprises and interface shaft (103) presenting a terminal end adapted for sliding interface with the bore of the tube casing (8) and being dimensioned to form a snug sliding fit with the through-bore (105) in the collar ring within which it is situated. An adjustment nut (104) extends into an opposite end of the interface assembly and projects from that opposite end by an amount/distance which is variably by screwing the adjustment bolt to move towards or away from the interface end of the interface assembly. In this way the extent to which the interface assembly projects outwardly of a collar ring towards an opposing bore surface may be varied. This variation may be achieved by initially removing the interface assembly from the through-bore (105), performing the length adjustment, and then reinserting the adjusted interface assembly into the through-bore.

The bollard assembly described above preferably forms a vehicle impact barrier or a part of a vehicle impact barrier.

The invention claimed is:

1. A bollard assembly comprising a housing part containing a hollow bollard part mounted therein to be slidingly moveable relative to the housing part, and an actuator part arranged within the hollow of the bollard part to urge the bollard part to move relative to the housing part from:

a refracted state unsupported by the actuator in which at least some of the length of the bollard part resides within the housing part, to an extended state supported by the actuator part in which relatively less of the length of the bollard part resides within the housing part and relatively more of said length extends beyond the housing part; and, a fixed stop part extending in to the hollow of the bollard part between the head of the bollard part and the actuator part; and, a detachable interface part arranged within the hollow of the bollard part between the stop part and the actuator part to abut the stop part and to be abutted by the actuator part to permit the actuator part via the interface part to support the bollard part at the stop part in the extended state;

wherein the actuator part is operable to disengage from the interface part when the bollard part is in the retracted state to permit the interface part to separate from the stop part to be detached therefrom to enable access to the actuator part within the hollow of the bollard part.

2. A bollard assembly according to claim 1 wherein a through-opening is formed in the interface part in register with the actuator part and the actuator part comprises a coupling part arranged to moveably engage with the interface part at the through-opening wherein:

the coupling part comprises a mid-section moveably extending through the through-opening and end sections located at opposite ends of the through-opening and dimensioned to prevent their passage through the through-opening thereby to retain the coupling part at the interface part and wherein the coupling part is moveable by action of the actuator between:

a first position in which an end section abuts an opposing surface of the interface part to urge the bollard part into the extended state; and, a second position in which the bollard is in a fully retracted state and said end section does not abut the interface part at said opposing surface.

3. A bollard assembly according to claim 2 in which the coupling part comprises a lower coupling part comprising one said end section and a separate upper coupling part comprising the other said end section and separable from the lower coupling part at said mid-section to permit removal of the interface part from the actuator part when in said second position.

4. A bollard part according to claim 1 wherein concavities are formed within the peripheral edge of the interface part which, when detached from the stop part, is rotatable within the hollow of the bollard part, to a position whereat said concavities are in register with the stop part such that the stop part does not obstruct removal of the interface part from the hollow of the bollard part.

* * * * *